US007152576B2

(12) United States Patent
Vanderpoel et al.

(10) Patent No.: US 7,152,576 B2
(45) Date of Patent: Dec. 26, 2006

(54) COMPACT LOST MOTION SYSTEM FOR VARIABLE VALUE ACTUATION

(76) Inventors: Richard Vanderpoel, 1 musket Trail, Bloomfield, CT (US) 06002; Zhou Yang, 8 Diggins Ct., South Windsor, CT (US) 06074; Andrew Brzoska, 119 Johnny Cake Mountain Rd., Burlington, CT (US) 06013; Brian L Ruggiero, 14 Seneca Dr., East Granby, CT (US) 06026; David B Smith, 20 Big Wood Dr., Westfield, MA (US) 01085; James Judd, 21 Lanz La., Ellington, CT (US) 06029; Neil E Fuchs, 70 Whitebeck Rd., New Hartford, CT (US) 06057; Michael P. Dailey, 203 Duncaster Rd., Bloomfield, CT (US) 06002; Steven N Ernest, 316 Palisado Ave., Windsor, CT (US) 06095

( * ) Notice: Subject to any disclaimer, the term of this patent is extended or adjusted under 35 U.S.C. 154(b) by 73 days.

(21) Appl. No.: 11/102,804

(22) Filed: Apr. 11, 2005

(65) Prior Publication Data

US 2005/0252484 A1 Nov. 17, 2005

Related U.S. Application Data

(63) Continuation-in-part of application No. 10/408,254, filed on Apr. 8, 2003, now Pat. No. 6,883,492.

(60) Provisional application No. 60/370,249, filed on Apr. 8, 2002.

(51) Int. Cl.
*F02D 13/04* (2006.01)
*F02D 13/06* (2006.01)

(52) U.S. Cl. ..... 123/321; 123/322; 123/90.12; 123/90.32; 123/90.44; 123/90.16

(58) Field of Classification Search ..... 123/321, 123/322, 90.12, 90.16, 90.32, 90.44
See application file for complete search history.

(56) References Cited

U.S. PATENT DOCUMENTS

| | | | | |
|---|---|---|---|---|
| 5,357,926 | A * | 10/1994 | Hu | 123/321 |
| 5,537,976 | A | 7/1996 | Hu | |
| 5,680,841 | A | 10/1997 | Hu | |
| 5,746,175 | A | 5/1998 | Hu | |
| 5,979,394 | A | 11/1999 | Schmidt | |
| 5,996,550 | A | 12/1999 | Israel et al. | |
| 6,125,828 | A | 10/2000 | Hu | |
| 6,189,504 | B1 | 2/2001 | Israel et al. | |
| 6,192,841 | B1 | 2/2001 | Vorih et al. | |
| 6,237,551 | B1 | 5/2001 | Macor et al. | |
| 6,244,257 | B1 | 6/2001 | Hu | |
| 6,257,183 | B1 | 7/2001 | Vorih et al. | |
| 6,267,098 | B1 | 7/2001 | Vanderpoel | |
| 6,273,057 | B1 | 8/2001 | Schwoerer et al. | |

(Continued)

*Primary Examiner*—Erick R Solis
(74) *Attorney, Agent, or Firm*—David R. Yohannan; Kelley Drye & Warren LLC

(57) ABSTRACT

Lost motion systems and methods for providing engine valves with variable valve actuation for engine valve events are disclosed. The system may include a master piston hydraulically linked to a slave piston, and a dedicated cam operatively connected to the master piston. The slave piston may be disposed substantially perpendicular to the master piston in a common housing. The slave piston is adapted to actuate one or more engine valves. The slave piston may incorporate an optional valve seating assembly into its upper end. A trigger valve may be operatively connected to the master-slave hydraulic circuit to selectively release and add hydraulic fluid to the circuit.

26 Claims, 20 Drawing Sheets

U.S. PATENT DOCUMENTS 6,293,237 B1 9/2001 Vorih
6,302,370 B1 10/2001 Schwoerer et al.
6,321,701 B1 11/2001 Vorih et al.
6,386,160 B1 5/2002 Meneely et al.
6,412,457 B1 7/2002 Vorih et al.
6,415,752 B1 7/2002 Janak
6,510,824 B1 1/2003 Vorih et al.
6,637,394 B1 10/2003 Marshall et al.
6,647,954 B1 11/2003 Yang et al.
6,668,773 B1 12/2003 Holtman et al.

* cited by examiner

COMPACT LOST MOTION SYSTEM FOR VARIABLE VALUE ACTUATION

CROSS REFERENCE TO RELATED APPLICATIONS

This application is a continuation in part of, relates to, and claims the priority of U.S. patent application Ser. No. 10/408,254 filed Apr. 8, 2003 now U.S. Pat. No. 6,883,492, which relates to and claims priority on U.S. provisional patent application Ser. No. 60/370,249 which was filed Apr. 8, 2002.

FIELD OF THE INVENTION

The present invention relates generally to a system and method for actuating a valve in an internal combustion engine. In particular, the present invention relates to a system and method that may provide variable actuation of intake, exhaust, and auxiliary valves in an internal combustion engine, and may provide a fail safe method so that the engine may be operated without damage in the event of a component failure.

BACKGROUND OF THE INVENTION

Valve actuation in an internal combustion engine is required in order for the engine to produce positive power. During positive power, one or more intake valves may be opened to admit fuel and air into a cylinder for combustion. One or more exhaust valves may be opened to allow combustion gas to escape from the cylinder. Intake, exhaust, and/or auxiliary valves also may be opened during positive power at various times to recirculate gases for improved emissions.

Engine valve actuation also may be used to produce engine braking and exhaust gas recirculation (EGR) when the engine is not being used to produce positive power. During engine braking, the exhaust valves may be selectively opened to convert, at least temporarily, the engine into an air compressor. In doing so, the engine develops retarding horsepower to help slow the vehicle down. This can provide the operator with increased control over the vehicle and substantially reduce wear on the service brakes of the vehicle.

In many internal combustion engines, the intake and exhaust valves may be opened and closed by fixed profile cams, and more specifically by one or more fixed lobes that are an integral part of each of the cams. Benefits such as increased performance, improved fuel economy, lower emissions, and better vehicle driveablity may be obtained if the intake and exhaust valve timing and lift can be varied. The use of fixed profile cams, however, can make it difficult to adjust the timings and/or amounts of engine valve lift in order to optimize them for various engine operating conditions, such as different engine speeds.

One proposed method of adjusting valve timing and lift, given a fixed cam profile, has been to provide variable valve actuation by incorporating a "lost motion" device in the valve train linkage between the valve and the cam. Lost motion is the term applied to a class of technical solutions for modifying the valve motion proscribed by a cam profile with a variable length mechanical, hydraulic, or other linkage assembly. In a lost motion system, a cam lobe may provide the "maximum" (longest dwell and greatest lift) motion needed over a full range of engine operating conditions. A variable length system may then be included in the valve train linkage, intermediate of the valve to be opened and the cam providing the maximum motion, to subtract or lose part or all of the motion imparted by the cam to the valve.

This variable length system (or lost motion system) may, when expanded fully, transmit all of the cam motion to the valve, and when contracted fully, transmit none or a minimum amount of the cam motion to the valve. An example of such a system and method is provided in Hu, U.S. Pat. Nos. 5,537,976 and 5,680,841, which are assigned to the same assignee as the present application and which are incorporated herein by reference.

In the lost motion system of U.S. Pat. No. 5,680,841, an engine cam shaft may actuate a master piston which displaces fluid from its hydraulic chamber into a hydraulic chamber of a slave piston. The slave piston in turn acts on the engine valve to open it. The lost motion system may include a solenoid trigger valve in communication with the hydraulic circuit that includes the chambers of the master and slave pistons. The solenoid valve may be maintained in a closed position in order to retain hydraulic fluid in the circuit when the master piston is acted on by certain of the cam lobes. As long as the solenoid valve remains closed, the slave piston and the engine valve respond directly to the hydraulic fluid displaced by the motion of the master piston, which reciprocates in response to the cam lobe acting on it. When the solenoid is opened, the circuit may drain, and part or all of the hydraulic pressure generated by the master piston may be absorbed by the circuit rather than be applied to displace the slave piston and the engine valve.

Previous lost motion systems have typically not utilized high speed mechanisms to rapidly vary the length of the lost motion system, although the aforementioned '841 patent does contemplate the use of a high speed trigger valve. High speed lost motion systems in particular, are needed to provide Variable Valve Actuation (VVA). True variable valve actuation is contemplated as being sufficiently fast as to allow the lost motion system to assume more than one length within the duration of a single cam lobe motion, or at least during one cycle of the engine. By using a high speed mechanism to vary the length of the lost motion system, sufficiently precise control may be attained over valve actuation to enable more optimal valve actuation over a range of engine operating conditions. While many devices have been suggested for realizing various degrees of flexibility in valve timing and lift, lost motion hydraulic variable valve actuation is becoming recognized for superior potential in achieving the best mix of flexibility, low power consumption, and reliability.

Engine benefits from lost motion VVA systems can be achieved by creating complex cam profiles with extra lobes or bumps to provide auxiliary valve lifts in addition to the conventional main intake and exhaust events. Many unique modes of engine valve actuation may be produced by a VVA system that includes multi-lobed cams. For example, an intake cam profile may include an additional lobe for EGR prior to the main intake lobe, and/or an exhaust cam profile may include an additional lobe for EGR after the main exhaust lobe. Other auxiliary lobes for cylinder charging, and/or compression release may also be included on the cams. The lost motion VVA system may be used to selectively cancel or activate any or all combinations of valve lifts possible from the assortment of lobes provided on the intake and exhaust cams. As a result, significant improvements may be made to both positive power and engine braking operation of the engine.

The foregoing benefits are not necessarily limited to exhaust and intake valves. It is also contemplated by the present inventors that lost motion VVA may be applied to an auxiliary engine valve that is dedicated to some purpose other than intake or exhaust, such as for example engine braking or EGR. By providing an auxiliary engine valve cam with all of the possible actuations that may be desired and a lost motion VVA system, the actuation of the auxiliary valve may be varied for optimization at different engine speeds and conditions.

In view of the foregoing, the lost motion system and method embodiments of the present invention may be particularly useful in engines requiring variable valve actuation for positive power, engine braking valve events (such as, for example, compression release braking), and exhaust gas recirculation valve events.

Each of the foregoing types of valve events (main intake, main exhaust, engine braking, and exhaust gas recirculation) occur as a result of an engine valve being pushed into an engine cylinder to allow the flow of gases to and from the cylinder. Each event inherently has a starting (opening) time and an ending (closing) time, which collectively define the duration of the event. The starting and ending times may be marked relative to the position of the engine (usually the crankshaft position) at the occurrence of each. These valve events also inherently include a point at which the engine valve reaches its maximum extension into the engine cylinder, which is commonly referred to as the valve lift. Thus, each valve event can be defined, at least at a basic level, by its starting and ending time, and the valve lift.

If the lost motion system connecting the engine cam to the engine valve has a fixed length each time a particular lobe acts on the system, then the starting and ending times and the lift for each event marked by that lobe will be fixed. Furthermore, a lost motion system that has a fixed length over the duration of the entire cam revolution will produce a valve event in response to each lobe on the cam, assuming that the system does not incorporate a lash space between the lost motion system and the engine valve. The optimal starting time, ending time, and lift of an engine valve is not "fixed," however, but may differ widely for different engine operating modes (e.g., different engine load, fueling, cylinder cut-out, etc.), for different engine speeds, and for different environmental conditions. Accordingly, it is desirable to have a lost motion system that is not fixed in length, but rather "variable" over the short run, where the short run is as brief as the duration of time it takes for a cam lobe to pass a fixed point (i.e. as little as a few cam shaft rotation degrees), or at least no longer than one cam shaft revolution.

It is also desirable to provide optimal power and fuel efficiency during positive power operation of an engine. One advantage of various embodiments of the present invention is that they may be used to vary the intake and exhaust valve timing and/or lift to provide optimal power and fuel efficiency, if so desired. The use of a lost motion VVA system allows valve timing and/or lift to be varied in response to changing engine conditions, load and speed. These variations may be made in response to real-time sensing of engine conditions and/or pre-programmed instructions.

It is also desirable to reduce NOx and/or other polluting emissions from the exhaust of internal combustion engines, and diesel engines in particular. One advantage of various embodiments of the present invention is that they may be used to reduce NOx and other polluting emissions by carrying out internal exhaust gas recirculation or trapping residual exhaust gas using variable valve timing and auxiliary lifts of intake, exhaust, and/or auxiliary valves. By allowing exhaust gas to dilute the incoming fresh air charge from the intake manifold, lower peak combustion temperatures may be achieved without large increases in fuel consumption, which may result in less formation of pollution and more complete burning of hydrocarbons.

Also of great interest for diesel engines is the capability of the engine to have an engine braking mode. It is another advantage of various embodiments of the present invention to optimize engine braking across an engine speed range, as well as modulate engine braking responsive to driver demand.

It is also desirable to provide engines with the ability to warm up faster by employing special valve timing during a brief period after the engine is started. Driver comfort and after-treatment device efficiencies may depend on how quickly an engine can be brought up to normal operating temperature. Yet another advantage of various embodiments of the present invention is that they may provide improved engine warm up. This can be achieved using a number of different techniques, including, but not limited to, early intake valve closing, EGR, changes in exhaust/intake valve overlap, cylinder cut-out of some cylinders, and even compression release braking of some cylinders during positive power to effectively make the engine work against itself.

The ability to provide cylinder cut-out may be useful not only during engine warm-up and not only for diesel engines. In some embodiments of the present invention, the lost motion VVA system may be adapted to lose all cam motions associated with an engine valve or even an engine cylinder. As a result, these lost motion VVA systems may be used to effectively "cut-out" or shut off one or more engine cylinders from inclusion in the engine. This ability may be used to vary the number of cylinders that fire during positive power, to add control over fuel efficiency and power availability. Cylinder cut-out may also increase exhaust gas temperature in the cylinders that continue to fire, thereby improving the efficiency of exhaust after-treatment. It is also contemplated that cylinder cut-out could be carried out sequentially at the time an engine is turned on and/or off to decrease the amount of out of balance shake that is produced by an engine during start-up and shut-down periods.

However, having a hydraulic circuit with various valves transferring motion from a cam or other motion imparting device to an engine valve may possess an increased risk of valve or engine damage or engine failure in the event a solenoid or trigger valve fails. In such a failure situation, the VVA system may be disabled such that the engine valves associated with the VVA system do not open or close as desired. This may result in engine failure. Further, in a failure situation the VVA system may be disabled with an engine valve in an open position. Such a position may lead to valve or engine damage due to valve-piston contact. Thus, a VVA system with a fail-safe attribute may be desirable.

Further, a hydraulic circuit for transferring motion from a cam or other motion imparting device to an engine valve may cause problems for engine valve actuation during start-up and warm-up. This is because hydraulic fluid may drain from the hydraulic circuit as the engine sits in a state of non-use. When the engine is started, the hydraulic circuit between the cam and engine valves may be empty, and therefore the valve may not be actuated. Thus, a secondary method of actuating the engine valves during start-up or warm-up is desirable.

Space and weight considerations are also of considerable concern to engine manufacturers. Accordingly it is desirable to reduce the size and weight of the engine subsystems responsible for valve actuation. Some embodiments of the present invention are directed towards meeting these needs by providing a compact master-slave piston housing for the lost motion VVA system. Applicants have discovered that some unexpected advantages may also be realized by reducing the size of the lost motion VVA system. As a result of reduction of the overall size of the system, the attendant hydraulic passages therein may be reduced in volume, thus improving hydraulic compliance.

Additional advantages of the invention are set forth, in part, in the description that follows and, in part, will be apparent to one of ordinary skill in the art from the description and/or from the practice of the invention.

SUMMARY OF THE INVENTION

Applicants have developed an innovative lost motion system that is capable of providing variable valve actuation. The system may include a master and slave piston circuit in communication with a high speed trigger valve. Selective actuation of the trigger valve may be used to provide a wide range of engine valve events of different durations and lifts.

Applicants have also developed an innovative lost motion valve actuation system comprising: a housing having a master piston bore and a slave piston bore, wherein the master piston bore and the slave piston bores intersect; a master piston slidably disposed in the master piston bore, wherein the master piston is adapted to receive an input motion; and a slave piston slidably disposed in the slave piston bore, wherein the slave piston is adapted to actuate one or more engine valves.

Applicants have further developed an innovative system for providing engine valves with variable valve actuation for engine valve events, said system comprising: a housing having a master piston bore and a slave piston bore; a master piston slidably disposed in the master piston bore; a cam operatively connected to the master piston, said cam dedicated to operation of the master piston; a slave piston slidably disposed in the slave piston bore, wherein the slave piston is selectively hydraulically linked to the master piston and adapted to actuate one or more engine valves; a valve seating assembly incorporated into the slave piston; and a trigger valve operatively connected to the slave piston bore.

Applicants have further developed an innovative lost motion valve actuation system comprising: a housing having a master piston bore and a slave piston bore, wherein the master piston bore and the slave piston bore extend axially in directions substantially perpendicular to each other; a master piston slidably disposed in the master piston bore, wherein the master piston is adapted to receive an input motion; and a slave piston slidably disposed in the slave piston bore, wherein the slave piston is adapted to actuate one or more engine valves.

Applicants have further developed an innovative system that provides a fail-safe attribute to a VVA system, said system comprising a housing having a master piston bore and a slave piston bore; a master piston slidably disposed in the master piston bore; a slave piston slidably disposed in the slave piston bore, wherein the slave piston is selectively hydraulically linked to the master piston and adapted to actuate one or more engine valves; a motion imparting device; a rocker arm pivotally disposed on a rocker shaft, wherein the rocker arm is adapted to receive motion from the motion imparting device and transfer said motion to the master piston; and a trigger valve operatively connected to the slave piston bore.

Applicants have further developed a second innovative system that provides a fail-safe attribute to a VVA system, said system comprising at least one engine valve; a housing having a master piston bore and a slave piston bore; a master piston slidably disposed in the master piston bore; a slave piston slidably disposed in the slave piston bore, wherein the slave piston is selectively hydraulically linked to the master piston and adapted to actuate one or more engine valves; a motion imparting device; a first rocker arm and second rocker arm pivotally and coaxially disposed on a rocker shaft, wherein the first rocker arm is adapted to receive motion from the motion imparting device and transfer said motion to the master piston and to the second rocker arm, and wherein the second rocker arm receives said motion from the first rocker arm; and a trigger valve operatively connected to the slave piston bore.

Applicants have still further developed an innovative method of providing variable valve actuation for an internal combustion engine valve using a slave piston hydraulically linked to a master piston for all non-failure mode valve actuations carried out by the engine valve, said method comprising the steps for: displacing the master piston in a master piston bore responsive to a cam motion; providing hydraulic fluid to a slave piston bore directly from the master piston bore responsive to displacement of the master piston; displacing the slave piston in the slave piston bore responsive to the provision of hydraulic fluid to the slave piston bore; actuating the engine valve responsive to displacement of the slave piston; and selectively releasing hydraulic fluid from and adding hydraulic fluid to the slave piston bore to achieve variable valve actuation.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

BRIEF DESCRIPTION OF THE DRAWINGS

In order to assist the understanding of this invention, reference will now be made to the appended drawings, in which like reference characters refer to like elements. The drawings are exemplary only, and should not be construed as limiting the invention.

DETAILED DESCRIPTION OF THE PRESENT INVENTION

Figure 1:
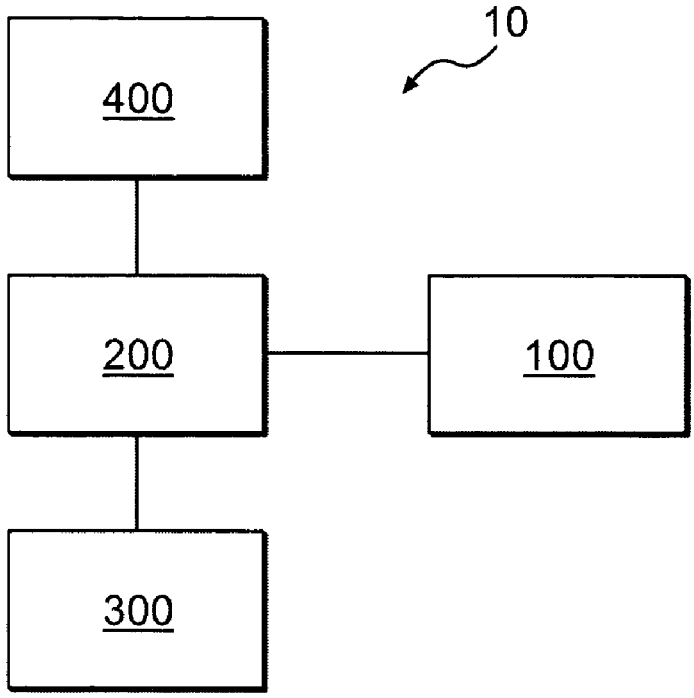
FIG. 1 is a block diagram of a valve actuation system according to a first embodiment of the present invention.

As embodied herein, the present invention includes both systems and methods of controlling the actuation of engine valves. Reference will now be made in detail to a first embodiment of the present invention, an example of which is illustrated in the accompanying drawings. A first embodiment of the present invention is shown in FIG. 1 as valve actuation system 10. The valve actuation system 10 includes a means for imparting motion 100 (motion means) connected to a lost motion system 200, which in turn is connected to one or more engine valves 300. The motion imparting means 100 provides an input motion to the lost motion system 200. The lost motion system 200 may be selectively switched between modes of: (1) losing the motion input by the motion means 100, and (2) transferring the input motion to the engine valves 300. The motion transferred to the engine valves 300 may be used to produce various engine valve events, such as, but not limited to, main intake, main exhaust, compression release braking, bleeder braking, external and/or internal exhaust gas recirculation, early exhaust valve opening, early intake closing, centered lift, etc. The valve actuation system 10, including the lost motion system 200, may be switched between a mode of losing motion and that of not losing motion in response to a signal or input from a controller 400. The engine valves 300 may be exhaust valves, intake valves, or auxiliary valves.

The motion imparting means 100 may comprise any combination of cam(s), push tube(s), and/or rocker arm(s), or their equivalents. The lost motion system 200 may comprise any structure that connects the motion imparting means 100 to the valves 300 and is capable of selectively transmitting motion from the motion imparting means 100 to the valves 300. In one sense, the lost motion system 200 may be any structure capable of selectively attaining more than one fixed length. The lost motion system 200 may comprise, for example, a mechanical linkage, a hydraulic circuit, a hydro-mechanical linkage, an electromechanical linkage, and/or any other linkage adapted to connect to the motion imparting means 100 and attain more than one operative length. When it incorporates a hydraulic circuit, the lost motion system 200 may include means for adjusting the pressure, or amount of fluid in the circuit, such as, for example, trigger valve(s), check valve(s), accumulator(s), and/or other devices used to release hydraulic fluid from or add hydraulic fluid to a circuit. The lost motion system 200 may be located at any point in the valve train connecting the motion imparting means 100 and the valves 300.

The controller 400 may comprise any electronic or mechanical device for communicating with the lost motion system 200 and causing it to either lose some or all of the motion input to it, or not lose this motion. The controller 400 may include a microprocessor, linked to other engine components, to determine and select the appropriate instantaneous length of the lost motion system 200. Valve actuation may be optimized at a plurality of engine speeds and conditions by controlling the instantaneous length of the lost motion system 200 based upon information collected by the microprocessor from engine components. Preferably, the controller 400 is adapted to operate the lost motion system 200 at high speed (one or more times per engine cycle).

Figure 4:
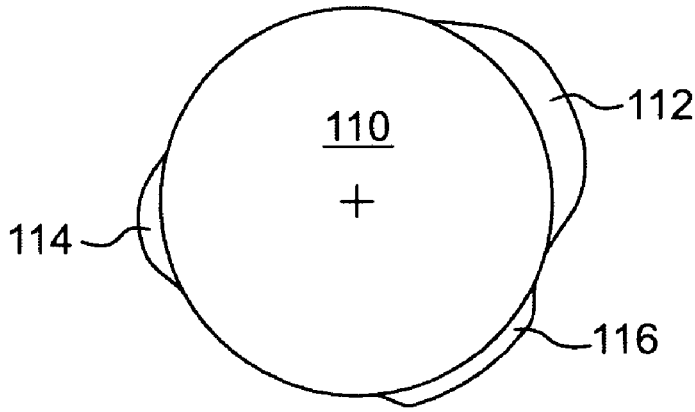
FIG. 4 is a schematic diagram of a cam having multiple lobes for use in connection with various embodiments of the present invention.
Figure 2:
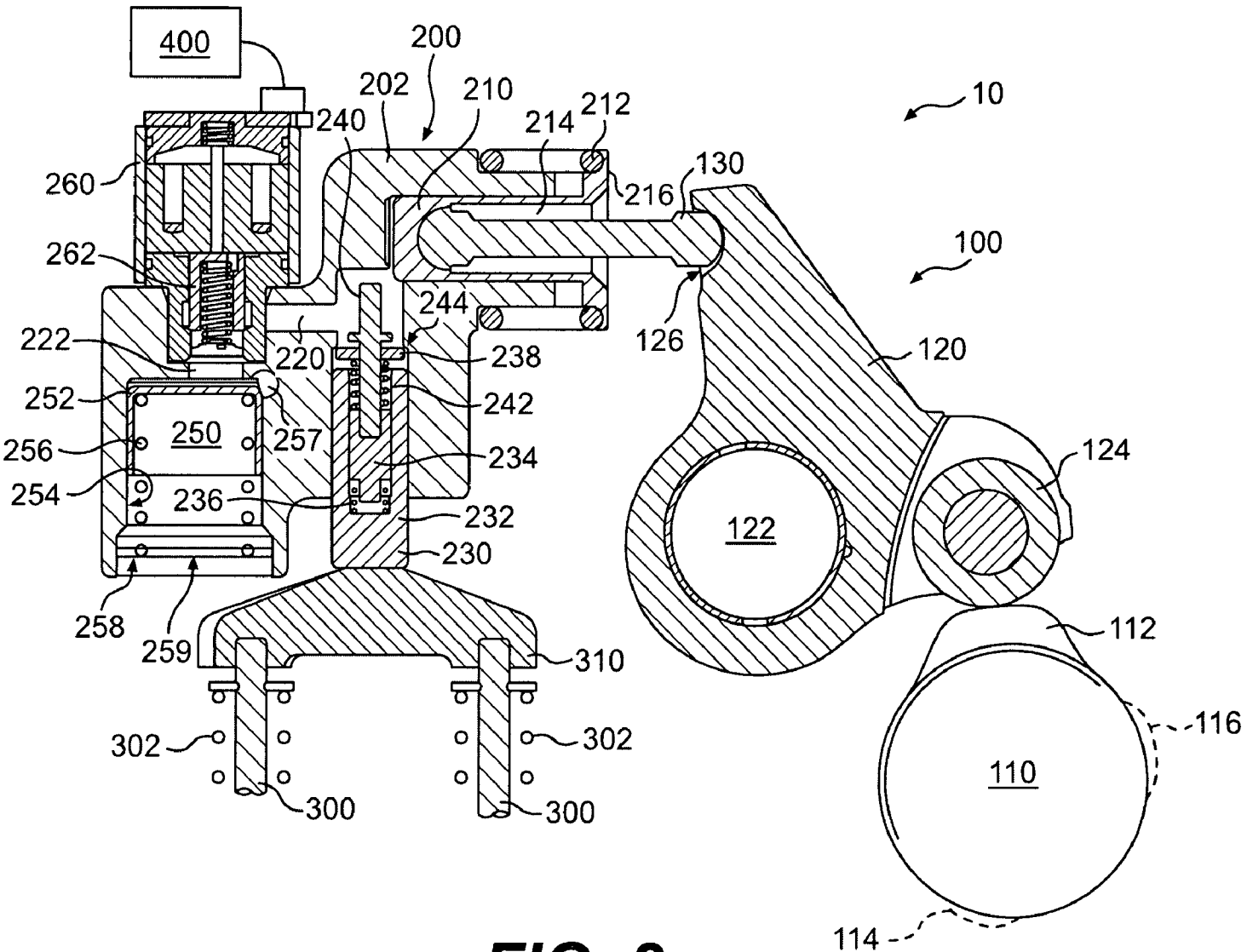
FIG. 2 is a schematic diagram of a valve actuation system according to a second embodiment of the present invention.

Another embodiment of the present invention is illustrated in FIG. 2. With reference thereto, the motion imparting means 100 may comprise a cam 110, a rocker arm 120, and a push tube 130. With reference to FIG. 4, the cam 110 may optionally include one or more lobes, such as a main (exhaust or intake) event lobe 112, an engine braking lobe 114, and an EGR lobe 116. The depictions of the lobes on the cam 110 are intended to be illustrative only, and not limiting. It is appreciated that the number, size, location, and shape of the lobes may vary markedly without departing from the intended scope of the invention.

With continued reference to FIG. 2, the cam 110 acts on the rocker arm 120. The rocker arm 120 may include a central opening 122 for receipt of a rocker shaft, and a cam follower 124. The rocker arm 120 is adapted to pivot back and forth about the central opening 122. Lubrication for the rocker arm 120 may be provided through the rocker shaft inserted into the central opening 122. The rocker arm 120 may also include a socket 126 for receipt of an end of the push tube 130. The socket may be designed to allow some pivot motion as the rocker arm 120 acts on the push tube 130.

The lost motion system 200 may include a housing 202, a master piston 210, a master-slave hydraulic circuit 220, a slave piston 230, an accumulator 250, and a trigger valve 260. The housing 202 may include a bore for receiving the master piston 210, a bore for receiving the slave piston 230, a bore 254 for receiving the accumulator, and a bore for receiving the trigger valve 260. The hydraulic circuit 220 is provided in the housing 202 and may connect the master piston 210, the slave piston 230, the trigger valve 260, and the accumulator 250. Hydraulic communication between the accumulator 250 and the other elements in the lost motion system may be controlled by using the trigger valve 260 to selectively open and close communication between the hydraulic circuit 220 and the passage 222 that extends between the trigger valve and the accumulator.

The master piston 210 may be disposed in a bore in the housing 202 such that it can slide back and forth in the bore while maintaining a hydraulic seal with the housing. It is anticipated that some leakage around this seal will not affect the operation of the lost motion system 200. The master piston 210 may include an interior socket 214 for receipt of a second end of the push tube 130. The end of the push tube 130 and the socket within the master piston 210 may be shaped to cooperate and permit a slight pivoting motion relative to each other. The master piston 210 may also include an outer flange 216 adapted to mate with a master piston spring 212. The master piston spring 212 may act on the flange 216 so as to bias the master piston 210 toward the rocker arm through the push tube 130. In turn, the rocker arm 120 is biased into the cam 110.

The master piston 210 may be disposed in the housing 202 in a direction substantially orthogonal or perpendicular to the orientation of the engine valves 300 and the slave piston 230. The master piston 210 bore and the slave piston 230 bore may have a short or zero fluid line lengths between them in various embodiments of the present invention. Master and slave piston bores with short or zero fluid line lengths may actually intersect, as shown in FIG. 2. The orthogonal orientation of the master piston 210, and the zero or near zero fluid line length between the master piston and slave piston bores, may enable the lost motion system 200 to be more compact than it might otherwise be. As a result hydraulic compliance challenges may be overcome by employing reduced hydraulic volumes. Thus, the orthogonal relationship of the master piston 210 and the slave piston 230 may provide a unique opportunity to both "save space" in the engine compartment, and provide the master and slave pistons in very close proximity.

The slave piston 230 may be slidably disposed in a bore in the housing 202 in an orientation substantially parallel with that of the engine valves 300. As shown in FIG. 2, the slave piston 230 acts on a valve bridge 310 associated with the engine valves 300. It is appreciated that the slave piston 230 could act directly on one or more engine valves in alternative embodiments of the invention.

The slave piston 230 may be selected to have a diameter of a selected proportion to that of the master piston 210. The relationship of these two diameters affects the relationship of the linear displacement of the slave piston 230 that occurs as a result of linear displacement of the master piston 210 given the hydraulic circuit connecting the two is closed. The ratio of the linear displacement of the master piston 210 to the resultant linear displacement of the slave piston 230 may be referred to as the hydraulic ratio of the pistons. It is appreciated that the optimal hydraulic ratio may vary in accordance with the specifications of the engine in which the lost motion system 200 is provided. The system 10 may employ a master piston 210 with an equal, larger, or smaller diameter compared to the slave piston 230. When the slave piston diameter is smaller, its stroke may be longer than that of the associated master piston. The preferred hydraulic ratio of the master piston to the slave piston may be in the range of 0.5 to 2.

The slave piston 230 may incorporate a valve seating assembly, also referred to as a valve catch. The valve seating assembly may include an outer piston 232, an inner piston 234, a lower spring 236 that biases the outer and inner pistons apart, a valve seating pin 240, a seating disk 238, and an upper spring 242 that biases the inner piston and the seating disk 238 apart. The outer piston 232 may be adapted to slide relative to the bore within which it resides, while at the same time forming a seal with that bore. It is appreciated that some leakage past this seal will not affect the operation of the lost motion system 200. The inner piston 234 may be adapted to slide within the outer piston 232 to accommodate the formation of a small fluid chamber (where the lower spring 236 resides) between the two pistons. Slow leakage to and from this small fluid chamber may provide for automatic lash adjustment between the slave piston 230 and the valve bridge 310. Accordingly, it is preferable to provide enough leakage space between the inner piston 234 and the outer piston 232 to enable automatic lash take up.

The combination of the seating pin 240 and the seating disk 238 may be provided to decelerate the upward motion of the slave piston and progressively slow the engine valves 300 as they approach their respective seats (not shown). The seating pin 240 may extend into the inner piston 234 at a lower end, and up into the hydraulic circuit 220 at an upper end. The seating pin 240 may include one or more side extensions that check the position of the seating pin relative to the seating disk 238. In an alternative embodiment of the present invention (shown in FIGS. 7 and 8), the seating pin 240 may be fluted to progressively throttle fluid flow past the seating pin/seating disk interface to maintain a relatively constant seating force during the last 1–2 mm before final valve seating. Examples of fluted seating pins are disclosed in Vanderpoel et al., U.S. Pat. No. 6,474,277 (Nov. 5, 2002), which is assigned to the owner of the present application, and which is hereby incorporated by reference.

The seating disk 238 may be slidably disposed in the slave piston bore. A small gap may be provided between the seating disk 238 and the slave piston bore to allow some low level of hydraulic flow around the seating disk. The upward movement of the seating disk 238, and the flow around its outer edge, may be checked by a shoulder 244 defined by the juncture of the slave piston bore and the hydraulic circuit 220. A gap that permits some low level of hydraulic fluid flow may also be provided between the interior of the seating disk 238 and the seating pin 240. The upward translation of the seating pin 240 may be arrested as a result of contact between the upper end of the seating pin and the housing 202. Contact between the seating pin and the housing may automatically set the lash for the system and also provide a valve catch function.

By incorporating the valve seating assembly into the slave piston 230, some embodiments of the present invention are able to locate three components affected by hydraulic compliance within a very small space, and thus improve compliance considerations. As a result, various embodiments of the present invention provide reduced, or even minimized, "dead volume" in the high pressure circuit bounded by the master piston 210, the slave piston 230, and the trigger valve 260.

The lost motion system 200 may also include a trigger valve 260. The trigger valve 260 may include an internal plunger 262 that is spring biased into a closed or opened position. The bias of the spring determines whether the trigger valve 260 is normally open, or normally closed. Some embodiments of the invention may use either a normally open or a normally closed trigger valve 260. If the trigger valve 260 is normally closed, for example, it will prevent the release of hydraulic fluid from the hydraulic circuit 220 to the accumulator 250 until it is energized and opened. This activation may occur rapidly, enabling the hydraulic fluid in the hydraulic circuit 220 to be released and recharged one or more times per cam revolution.

When the trigger valve 260 is open, hydraulic fluid in the circuit 220 is free to flow to the accumulator 250. The accumulator 250 may include an accumulator piston 252 mounted in an accumulator bore 254, an accumulator spring 256, and a retaining device 258. The retaining device 258 may be used to retain the spring 256 such that it biases the accumulator piston 252 up into the bore 254. The accumulator may be recharged with hydraulic fluid via a feed passage 257. The feed passage 257 may optionally include a local check valve provided to prevent the back flow of hydraulic fluid from the accumulator to the feed passage. Hydraulic fluid leakage out of the accumulator 250 may pass through the opening 259 in the retaining device 258. The force of the accumulator spring 256 may be selected to be less than the force of the valve return springs 302 but great enough to rapidly recharge the hydraulic circuit 220 when the need arises.

The accumulator 250 may also provide a means for cooling the hydraulic fluid contained in the lost motion system 200. The accumulator piston 252 may include a bleed hole extending through its upper surface, or a flattened surface extending along its side wall. The bleed hole or flattened surface may allow a small amount of hydraulic fluid to leak out of the accumulator 250 as it operates. This small amount of leakage may be constantly replenished with fresh, cool hydraulic fluid from the feed passage 257. The net effect of this constant leakage and replenishment is to cool the hydraulic fluid supply in the lost motion system 200.

A localized low pressure source of hydraulic fluid may also communicate with the hydraulic circuit 220. Although not shown in the drawing figures, it is appreciated that a local source of hydraulic fluid could communicate with the hydraulic circuit 220 through a check valve. This local source of hydraulic fluid could be used to charge the hydraulic circuit 220 with fluid upon cold start. It is appreciated that this local reservoir of hydraulic fluid may be integrated into the housing 202.

With continued reference to FIG. 2, the functioning of the system 10 is as follows. As the cam 110 rotates, the follower 124 on the rocker arm 120 may follow the surface of the cam, causing the rocker arm to pivot about the central opening 122. As the rocker 120 pivots, it transfers the motion of the cam 110 to the push tube 130, which in turn transfers the motion to the lost motion system 200. When the motion is transferred through the lost motion system 200, the valves 300 are actuated to produce an engine valve event. Any of the foregoing discussed engine valve events may be provided. The amount of motion transferred from the cam 110 to the valves 300 is controlled by the instantaneous length of the lost motion system 200.

The instantaneous length of the lost motion system 200 is controlled by the trigger valve 260 and the accumulator 250. When the trigger valve 260 is in a closed position, hydraulic fluid may first fill (past an optional check valve that is not shown), and then be retained in the circuit 220. Hydraulic fluid may fill the circuit 220 when the master piston 210 is pushed out of its bore by the spring 212. As the master piston 210 moves outward, it may draw fluid into the circuit 220. Additionally, the hydraulic fluid may be pumped into the hydraulic circuit 220. The fluid in the circuit 220 may cause the outer slave piston 232 to be pushed downward against the valve bridge 310. As the outer slave piston 232 moves downward, the seating disk 238 may also move downward slightly to allow fluid to fill the space between the seating disk 238 and the outer slave piston 232. The seating disk 238 may not move downward very far, however, because it is biased upward by the upper spring 242. The downward movement of the outer slave piston 232 may also produce some downward movement of the inner slave piston 234 and some relative movement of the seating pin 240. Essentially, the elements of the slave piston that are responsible for controlling valve seating, namely, the seating disk 238, the seating pin 240, and the inner slave piston 234, separate and retain fluid between them. During valve seating, the controlled and limited flow of fluid from the spaces between these elements may be used to slow the valve down as these elements are effectively squeezed together.

After lash between the slave piston and the valve bridge 310 is removed, movement of the master piston 210 (by the cam 110, the rocker 120, and the push tube 130) is transferred to the slave piston 230 by the lost motion system 200. As a result, the slave piston 230 moves downward and actuates the valves 300 when the master piston 210 is pushed into its bore. During this operation, the outer slave piston 232, the inner slave piston 234, the seating disk 238, and the seating pin 240 essentially move together for valve lift events. As long as the trigger valve 260 remains closed, the slave piston 230 and the valves 300 may respond directly to the motion of the master piston 210.

The pumping action of the master piston 210 also helps ensure that hydraulic fluid will seep into the small chamber between the outer slave piston 232 and the inner slave piston 234 to take up any lash between the slave piston and the valve bridge 310. The self-adjusting lash feature of the outer and inner slave pistons may compensate for thermal expansion and contraction of valve train components as well as adjust for wear of the components over the life of the engine.

If it is desired to lose the motion of any part or whole of any lobe on the cam 110, then the trigger valve may be opened to decouple the slave piston 230 from the master piston 210. When the trigger valve 260 is opened, the hydraulic circuit 220 may drain in part to the accumulator 250, and the slave piston 230 may be returned by the valve spring 302. All or part of the hydraulic pressure in the hydraulic circuit 220 generated by the pumping motion of the master piston 210 may be absorbed by the accumulator 250 and the feed passage 257. As a result, the slave piston 230 may not be displaced in response to the movement of the master piston 210, or the slave piston may collapse towards the master piston. As the hydraulic fluid in the circuit 220 drains, the force of the valve return springs 302 causes the slave piston 230 to be forced upward. As the outer slave piston 232 moves upward, it acts on the inner slave piston 234 as a result of the trapped fluid between the two. The upward movement of the outer slave piston 232 also forces fluid past the outside and the inside of the seating disk 238. The combined upward movement of the outer and inner slave pistons, however, forces the seating disk 238 upward against the shoulder 244 due to the bias force of the upper spring 242. This causes the fluid flow out of the slave piston bore to be reduced to that flow which can escape through the small space between the seating disk 238 and the seating pin 240. The pin 240 may optionally be provided with flutes (FIGS. 7 and 8) along its sides to facilitate the flow of fluid past it. As a result of the foregoing, the fluid flow out of the slave piston bore is pinched off as the slave piston 230 indexes upward. This in turn, acts to slow the slave piston 230 down as the engine valves 300 approach their seats.

With continued reference to FIG. 2, it may be particularly desirable to design the lost motion system 200 such that a failure of the trigger valve 260 always results in an open hydraulic path between the master-slave piston circuit 220 and the accumulator 250. Trigger valve failure in the open position may be desirable because the alternative (failure in the closed position) could result in contact between the engine valve 300 and the engine piston (not shown). If the trigger valve 260 fails in a closed position, it is not possible to vent the hydraulic fluid from the master-slave circuit 220. As a result, the slave piston 230 may experience the full displacement of each lobe on the cam 110. If insufficient lash exists between the slave piston 230 and the valve bridge 310, the full main valve event 112 could cause the slave piston to travel so far downward that the engine valve 300 risks contacting the engine piston.

Although it is preferred that the trigger valve 260 be designed to remain open during failure, it is appreciated that in an alternative embodiment of the present invention, the trigger valve 260 could be designed to remain closed in the event of a failure.

Figure 3:
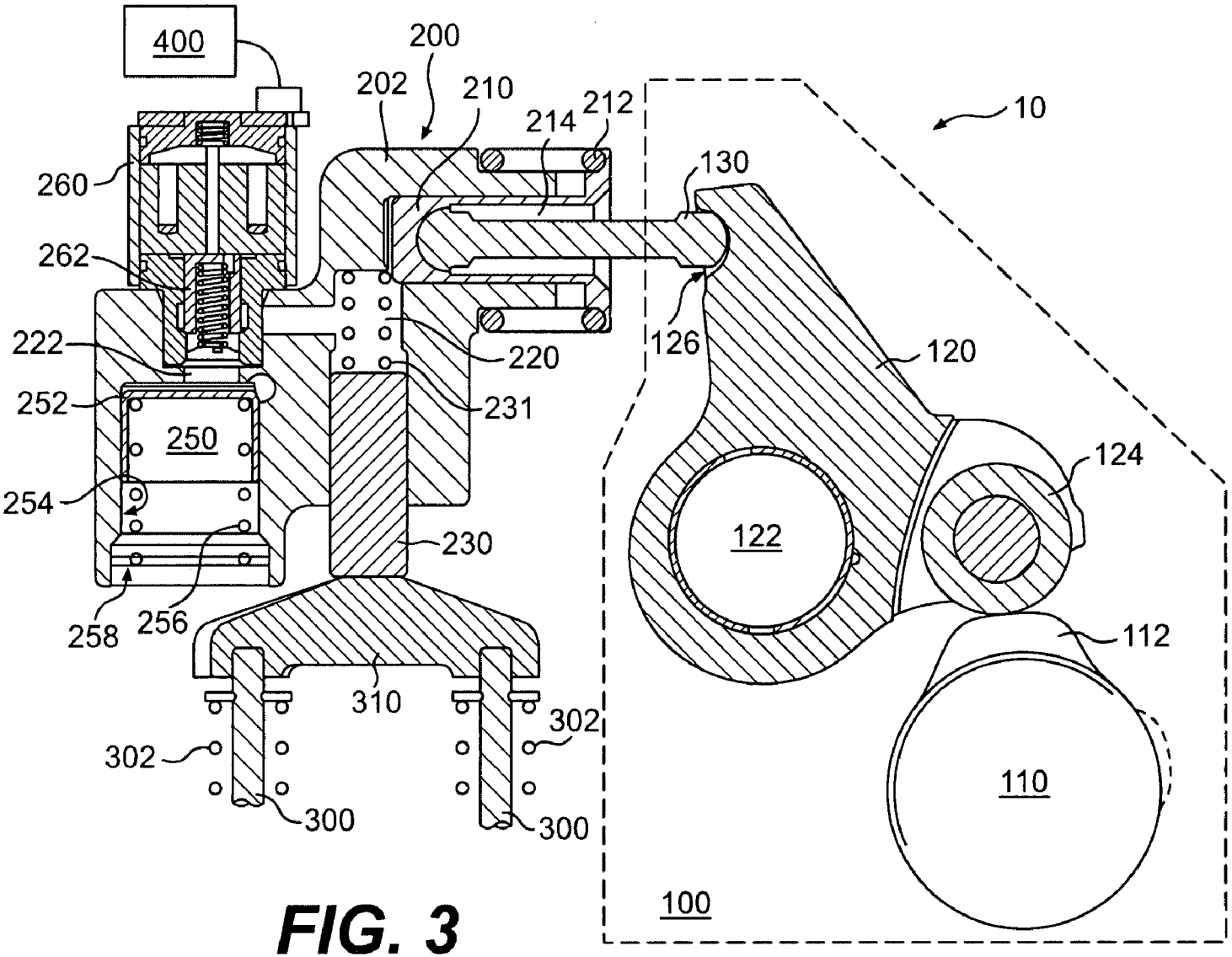
FIG. 3 is a schematic diagram of a valve actuation system according to a third embodiment of the present invention.

FIG. 3 shows another embodiment of the present invention in which like reference characters refer to like elements. The embodiment shown in FIG. 3 differs from that shown in FIG. 2 in that it does not incorporate valve seating elements into the slave piston 230. The solid slave piston 230 is biased downward by a spring 231. Depending upon its strength, the spring 231 may provide some valve seating counter-force. It is appreciated that other valve seating elements may be connected to the hydraulic circuit 220, or not, as the case may be, in alternative embodiments of the invention.

Figure 5:
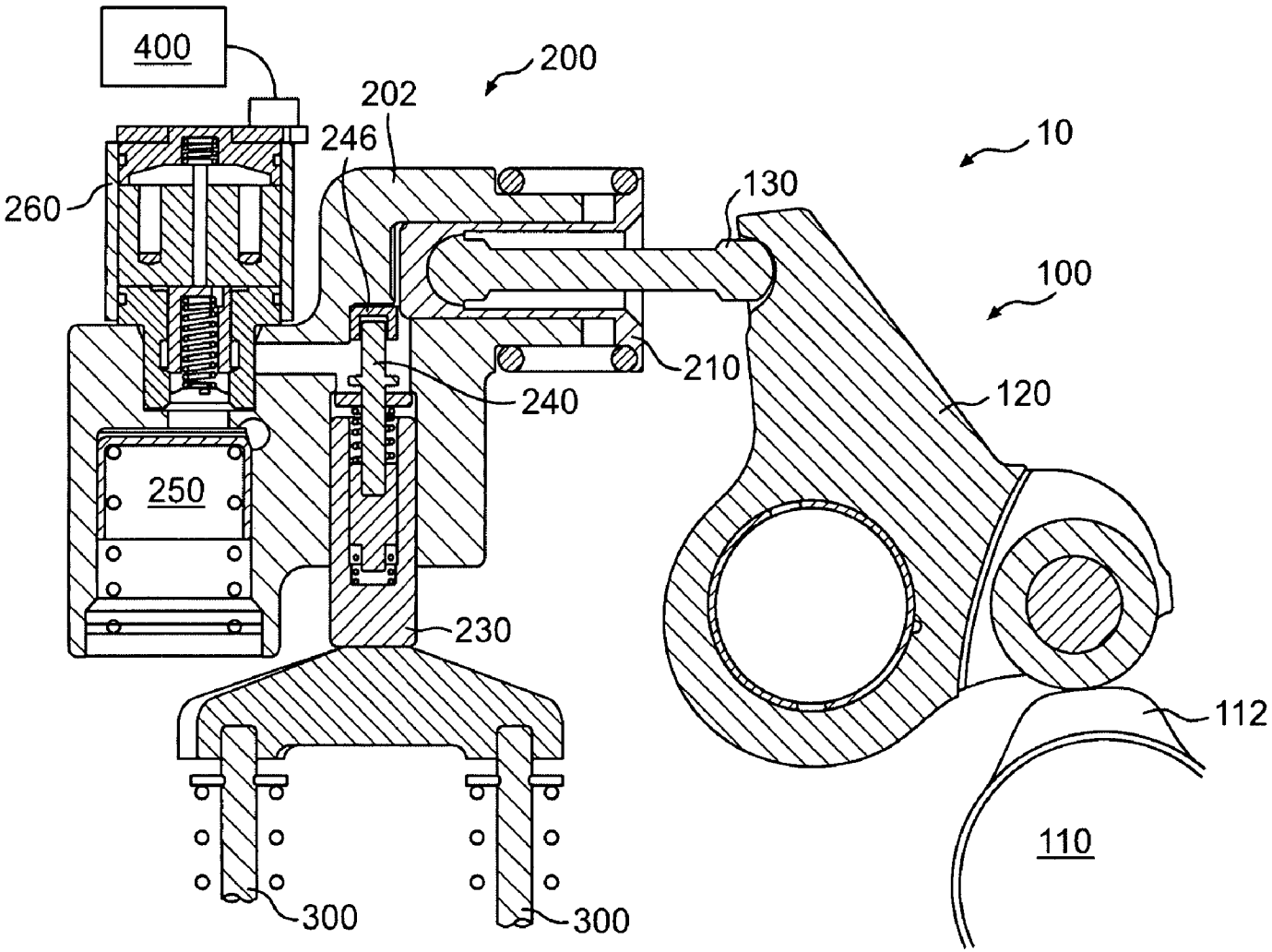
FIG. 5 is a schematic diagram of a valve actuation system according to a fourth embodiment of the present invention.

FIG. 5 shows yet another embodiment of the present invention, in which a hardened cup 246 may be pressed into the housing 202 above the seating pin 240. The hardened cup 246 may be used to cushion any impact that may occur between the seating pin 240 and the interior of the housing 202. The cup 246 may be considered "hard" as compared with the material from which the housing 202 is constructed. Use of the hardened cup 246 may allow use of a relatively softer material for the housing 202, thereby making the housing easier and less expensive to machine. It is understood that the hardened cup 246 is not necessary for all embodiments of the inventions, but rather that it is an optional component that may be desirable in certain circumstances.

Figure 6:
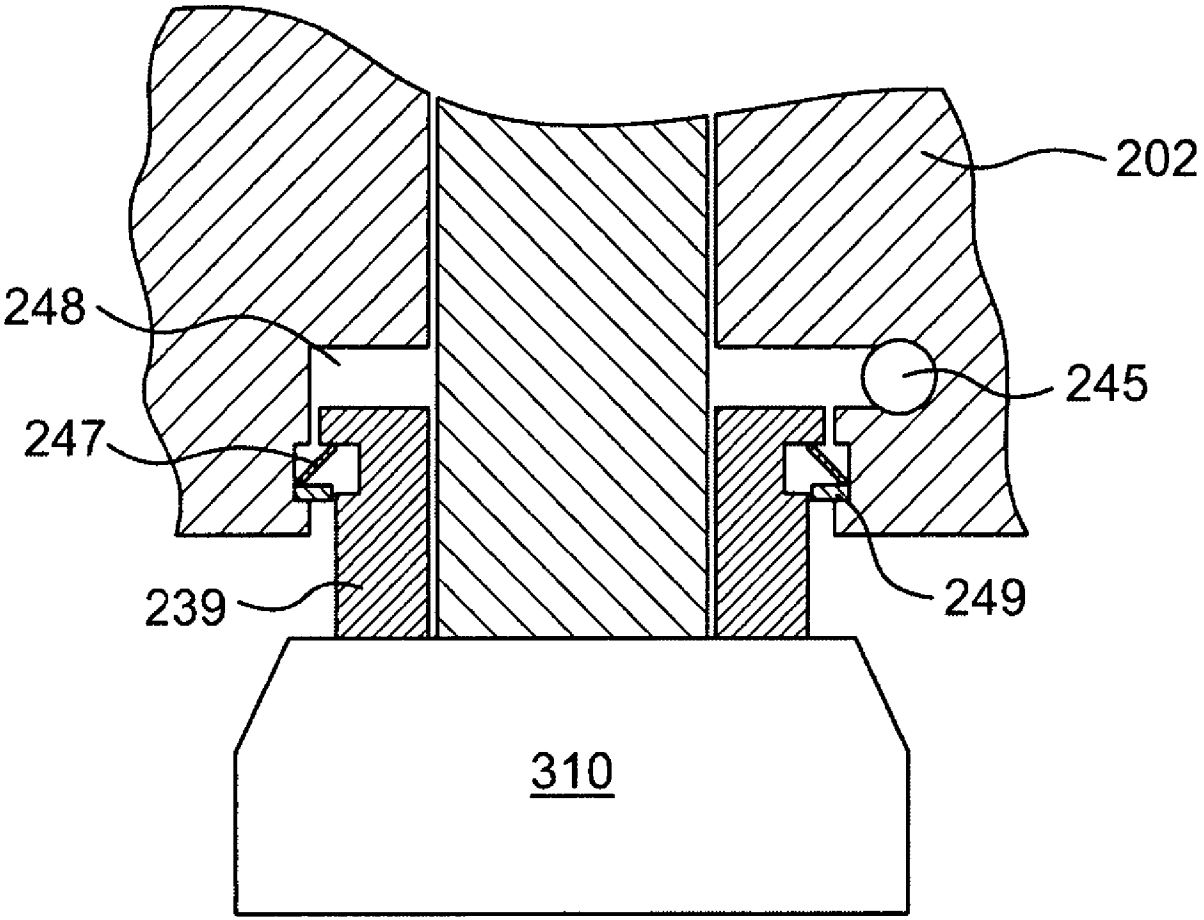
FIG. 6 is a schematic diagram of an alternative embodiment of the invention in which a bleeder braking hydraulic plunger is integrated into a lower portion of the system housing.
Figure 14:
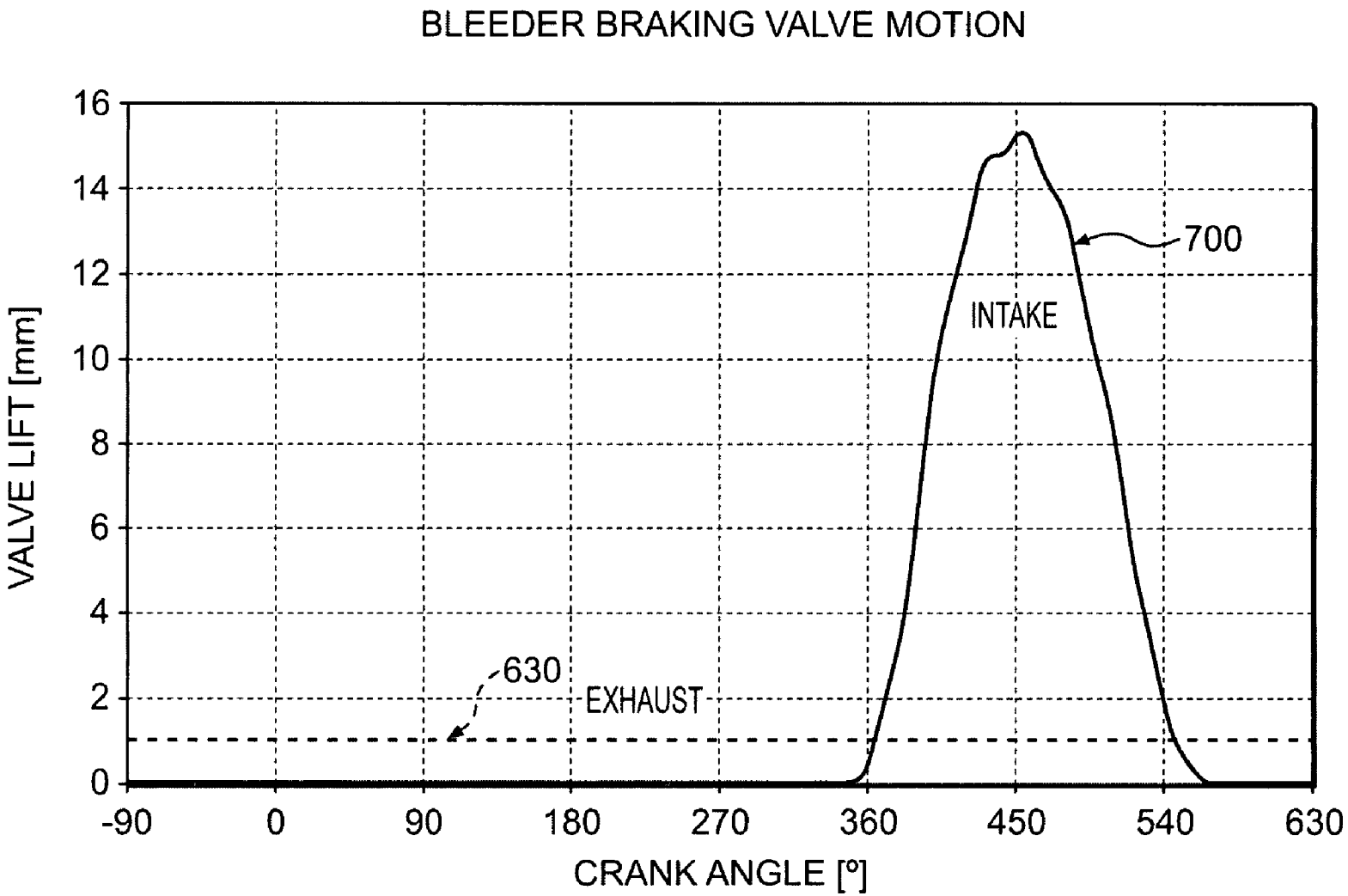
FIG. 14 is a graph of engine valve lift verses crank angle illustrating bleeder braking.

FIG. 6 is a schematic cross-sectional view of the region surrounding a lower portion of a slave piston 230 such as those shown in FIGS. 2, 3, 5, 7, and 9, with the addition of a bleeder braking hydraulic plunger 239. An example of the bleeder braking valve actuation that may be provided is illustrated in FIG. 14. Bleeder braking may be accomplished by cracking open one or more exhaust valves so that they are open throughout much or all of the engine cycle during an engine braking mode. As a result, exhaust gas bleeds out of the cylinder into the exhaust manifold during each exhaust and compression stroke. Engine noise associated with bleeder braking may be reduced as compared with that produced by compression-release braking. Bleeder braking may be enhanced when conducted in conjunction with an exhaust restriction device.

With continued reference to FIG. 6, the bleeder braking hydraulic plunger 239 is disposed in a lower housing cavity 248. The hydraulic plunger 239 may be slidably retained in the lower housing cavity 248 by a plunger stop 249. The plunger stop 249 may be a ring snapped into the wall of the housing 202. A low pressure hydraulic feed 245 may provide hydraulic fluid to the housing cavity 248 to actuate the hydraulic plunger 239. A hydraulic control valve may be used to control the supply of fluid to the feed 245. When the control valve is actuated, hydraulic fluid may fill the cavity 248 and lock the hydraulic plunger 239 into its lowermost position. When the control valve is de-actuated, the fluid in the cavity 248 may drain back through the feed 245. The spring 247 may assist in retracting the hydraulic plunger back into the cavity 248 when the control valve is de-actuated.

During ordinary (non-bleeder brake mode) operation of the lost motion systems 200 shown in FIGS. 2, 3, 5, 7, and 9, the bleeder brake hydraulic plunger 239 may be fully collapsed into the lower housing cavity 248. During this time valve actuation occurs in response to the master-slave piston motion.

Hydraulic fluid may be released from the master-slave circuit 220 when bleeder braking is desired. Release of fluid from the master-slave circuit 220 may cause the outer slave piston 232 to collapse into its bore. Hydraulic fluid may be supplied from the low pressure feed 245 to the housing cavity 248 causing the hydraulic plunger 239 to extend downward. In turn, the downward extension of the hydraulic plunger 239 may crack open one or more exhaust valves so that bleeder brake operation begins. When cessation of bleeder braking is desired, provision of hydraulic fluid from the low pressure feed 245 may be discontinued, allowing the hydraulic plunger 239 to again collapse into the housing cavity 248.

Figure 7:
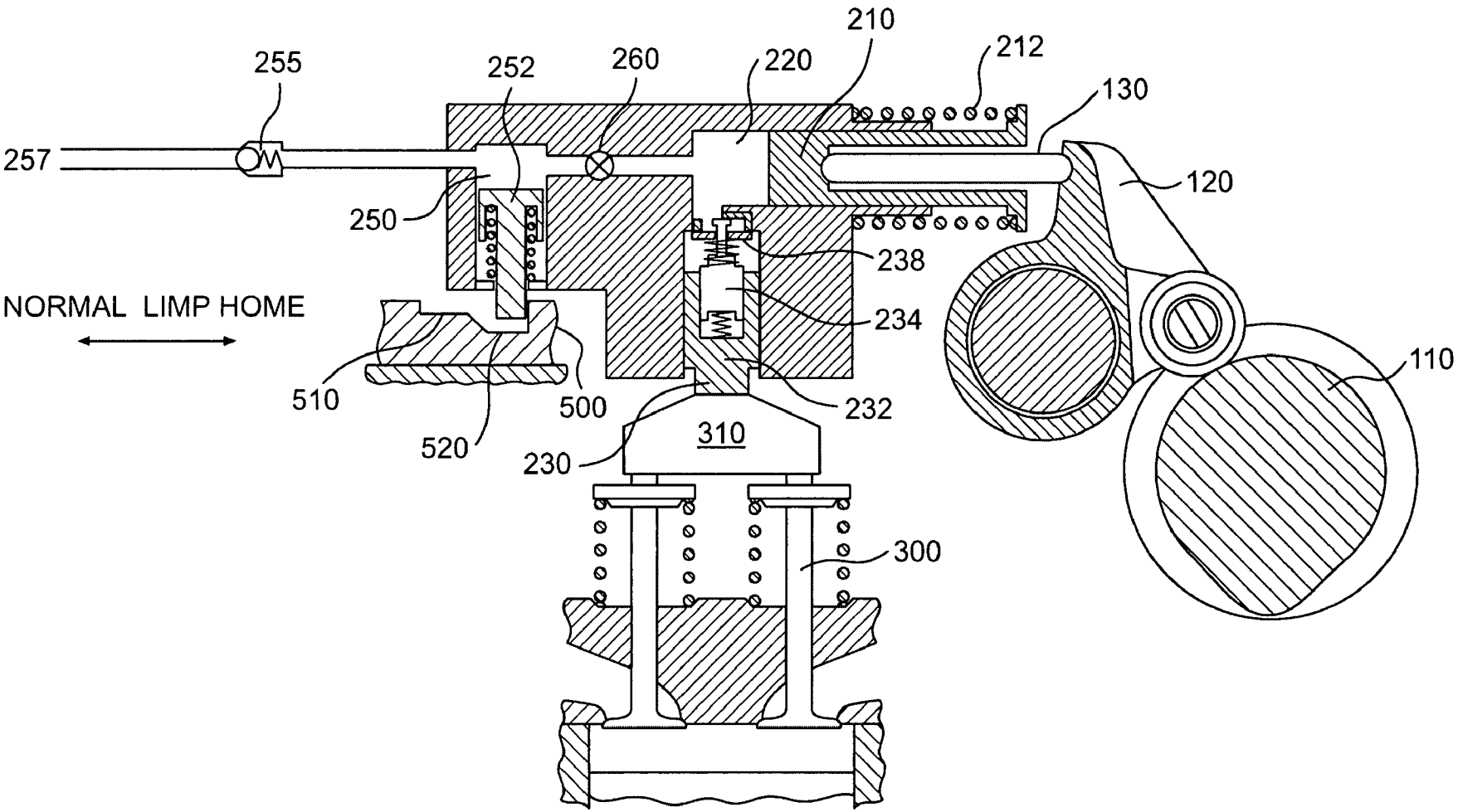
FIG. 7 is a schematic diagram of another alternative embodiment of the invention including means for limiting the accumulator volume to provide a limp-home mode of operation.

Another alternative embodiment of the invention is shown in FIG. 7 in which the master piston bore extends over the slave piston bore. The positioning of the master piston bore over the slave piston bore may further enhance the systems compactness. As shown, a short hydraulic passage may connect the master piston bore to the slave piston bore. The master piston 210 may partially occlude the short hydraulic passage when the master piston is at its deepest position in its bore.

The lost motion system 200 shown in FIG. 7 also includes a stop 500 for selectively limiting the range of motion of the accumulator piston 252 relative to the bore 254. This embodiment of the invention may be particularly useful when the trigger valve 260 is designed to remain open in the event it fails. The operation of the stop 500 may provide the lost motion system 200 with the capability of providing some level of valve actuation in the event that the trigger valve 260 fails (i.e., a failure mode of operation).

The stop 500 may include an elevated surface 510 and a depressed surface 520. The elevated and depressed surfaces may be adapted to selectively limit the downward travel of the accumulator piston 252, thereby limiting maximum accumulator volume. When the depressed surface 520 is positioned below the accumulator piston 252, as shown in FIG. 7, the accumulator piston may be free to move through the full range of motion required for operation of the lost motion system in a non-failure mode.

During a failure mode, the stop 500 may be moved so that the elevated surface 510 is positioned below the accumulator piston 252. The elevated surface 510 may hold the accumulator piston 252 in an elevated position, such that the fluid volume of the accumulator 250 is reduced. Reduction of the accumulator volume may allow the master piston 210 to become hydraulically locked with the slave piston 230 even when the trigger valve 260 fails in an open position. The height of the elevated surface 510, and thus the elevated position of the accumulator piston 252, may be selected so that the slave piston provides only a reduced level of valve actuation (e.g., main intake or main exhaust), or a full level of valve actuation, when the trigger valve fails in an open position. In this manner, the stop 500 may provide the lost motion system 200 with the ability to operate at a reduced level of efficiency so as to "limp home" for repair of the trigger valve.

It is appreciated that the stop 500 may take any number of forms other than that shown in FIG. 7, which is intended to be exemplary only. The stop 500 need only perform the function of selectively fixing the lower most position of the accumulator piston 252 so that the maximum accumulator volume is reduced during a failure mode. The stop function may be provided by any suitable mechanical, electric, hydraulic, pneumatic, or other means.

Figure 8:
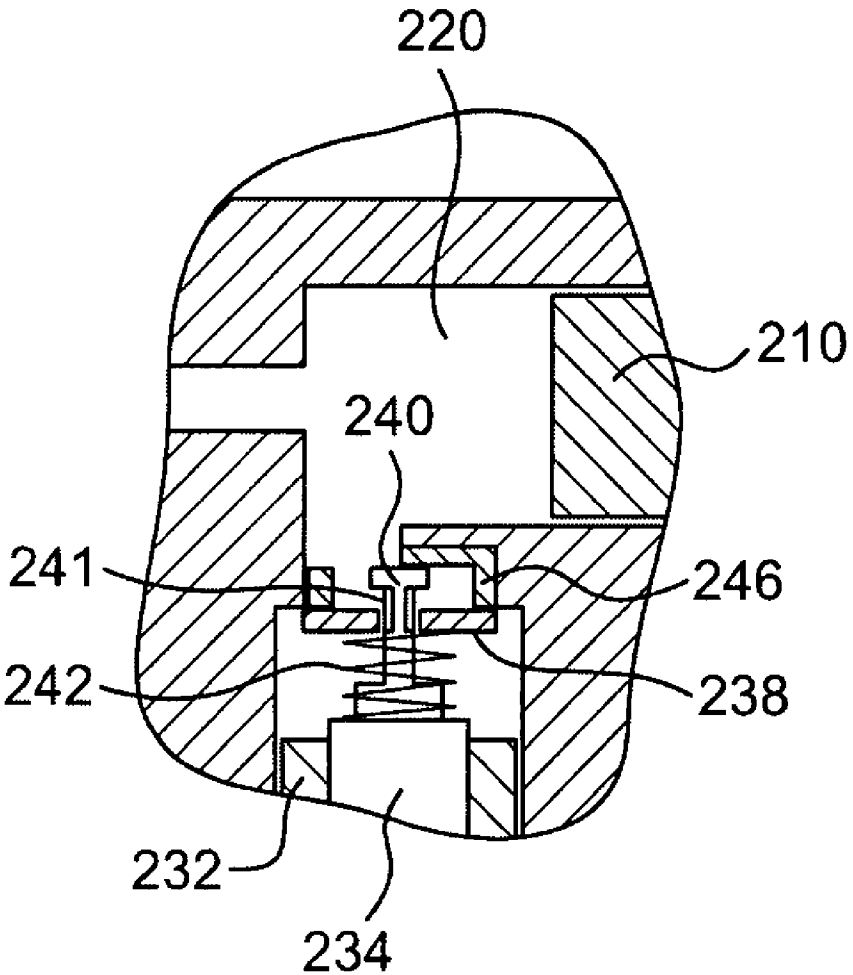
FIG. 8 is a schematic diagram of the upper slave piston region, and more specifically the valve seating assembly, shown in FIG. 7.

The embodiment of the present invention shown in FIG. 7 also includes valve seating elements that differ slightly from those shown in FIGS. 2, 3, and 5. FIG. 8 is an enlarged view of the valve seating elements shown in FIG. 7. The valve seating elements may include an inner slave piston 234, a seating disk 238, a seating pin 240, an upper spring 242, and a hardened cup 246. The valve seating elements are shown in the position attained when the engine valve 300 is closed or seated. The seating pin 240 is disposed between the inner slave piston 234 and the hardened cup 246. The seating pin 240 may move up and down with the inner slave piston 234. The seating disk 238 may be spring biased against the hardened cup 246. One or more flutes may be provided on the seating pin 240 to throttle fluid flow between the seating pin and the seating disk 238 as the seating pin approaches the harden cup 246. The hardened cup 246 may be pressed into the housing and provided with an off-center opening designed to throttle fluid flow past the cup during engine valve closing.

Figure 9:
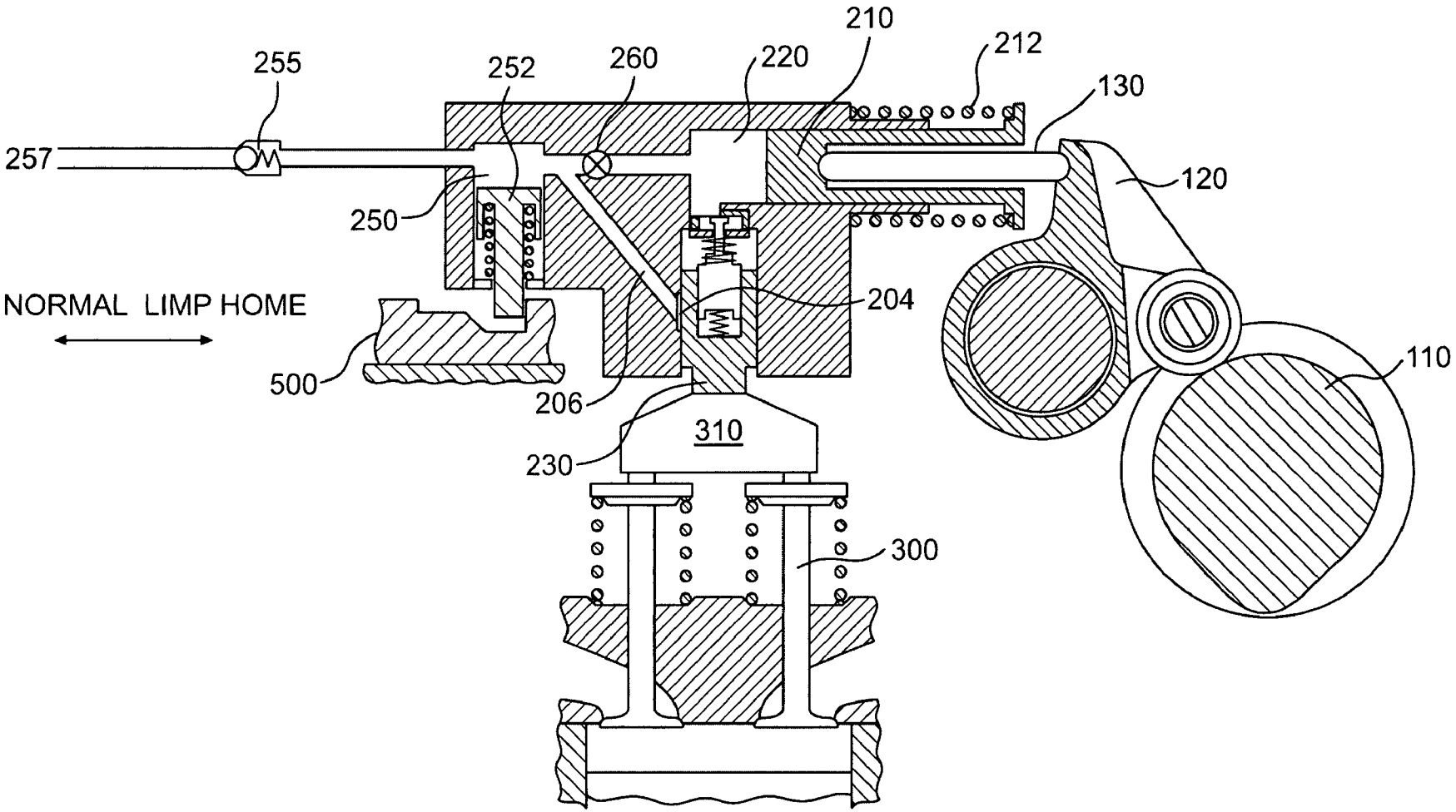
FIG. 9 is a schematic diagram of another alternative embodiment of the present invention including a clipping passage for the slave piston.

Another alternative embodiment of the present invention is illustrated by FIG. 9. The embodiment shown in FIG. 9 is similar to the embodiment shown in FIG. 7. In FIG. 8, an additional design feature may prevent the slave piston 230 from extending past a preset lower limit. In this embodiment of the invention, a clipping port 204 may be incorporated into the wall of the slave piston bore. A clipping passage 206 may connect the clipping port 204 to the accumulator 250. Each time the slave piston 230 travels sufficiently downward that the upper edge of the slave piston clears the clipping port 204, the high pressure hydraulic fluid in the master-slave circuit 220 may drain through the clipping passage 206 to the accumulator 250. This effectively limits or "clips" the downward travel of the slave piston 230. Selective placement of the clipping port 204 relative to the dimension of the slave piston 230 may prevent over travel of the slave piston and the engine valve 300.

Figure 16:
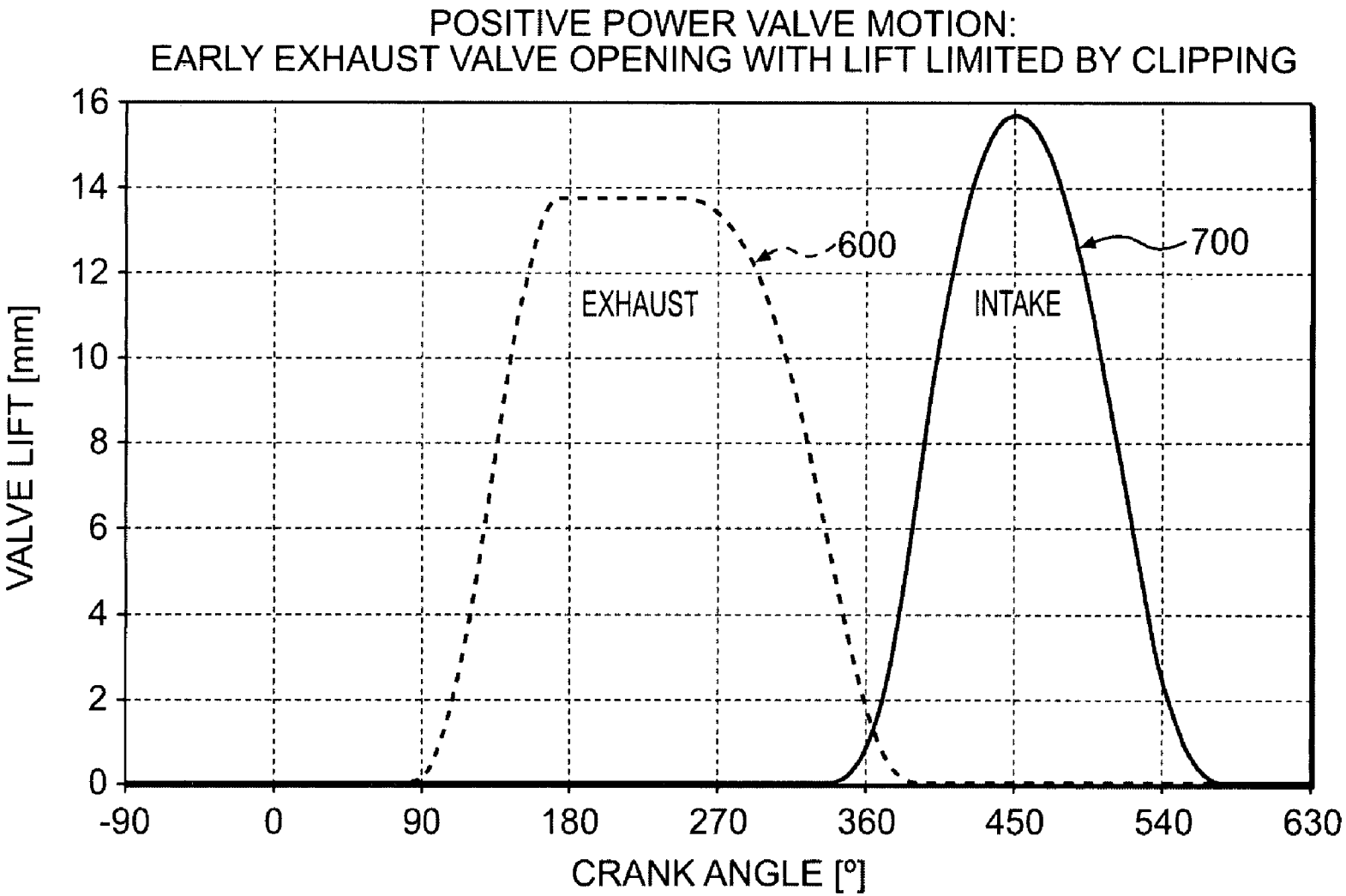
FIG. 16 is a graph of engine valve lift verses crank angle illustrating early exhaust valve opening during positive power operation.

The embodiment of the invention shown in FIG. 9 may be particularly useful to carry out early exhaust valve opening during positive power operation of the system. Early exhaust valve opening is illustrated in FIG. 16 by exhaust valve motion 606. Early exhaust valve opening may be used to stimulate turbocharger boost, particularly at low engine speeds. This may produce improved low speed engine torque.

With reference to FIGS. 9 and 16, early exhaust valve opening may be achieved by providing an exhaust cam 110 with an enlarged main exhaust lobe. The enlarged main exhaust lobe causes the master-slave piston combination to actuate the exhaust valve 300 at an earlier time in the engine cycle than it otherwise would. As a result, the exhaust valve 300 runs the risk of extending farther into the engine cylinder than it otherwise would, and potentially impacting the engine piston in the cylinder. The clipping port 204 and clipping passage 206 may prevent over travel of the exhaust valve 300 by limiting the extension of the slave piston 230 out of the bore in which it is disposed.

Figure 10:
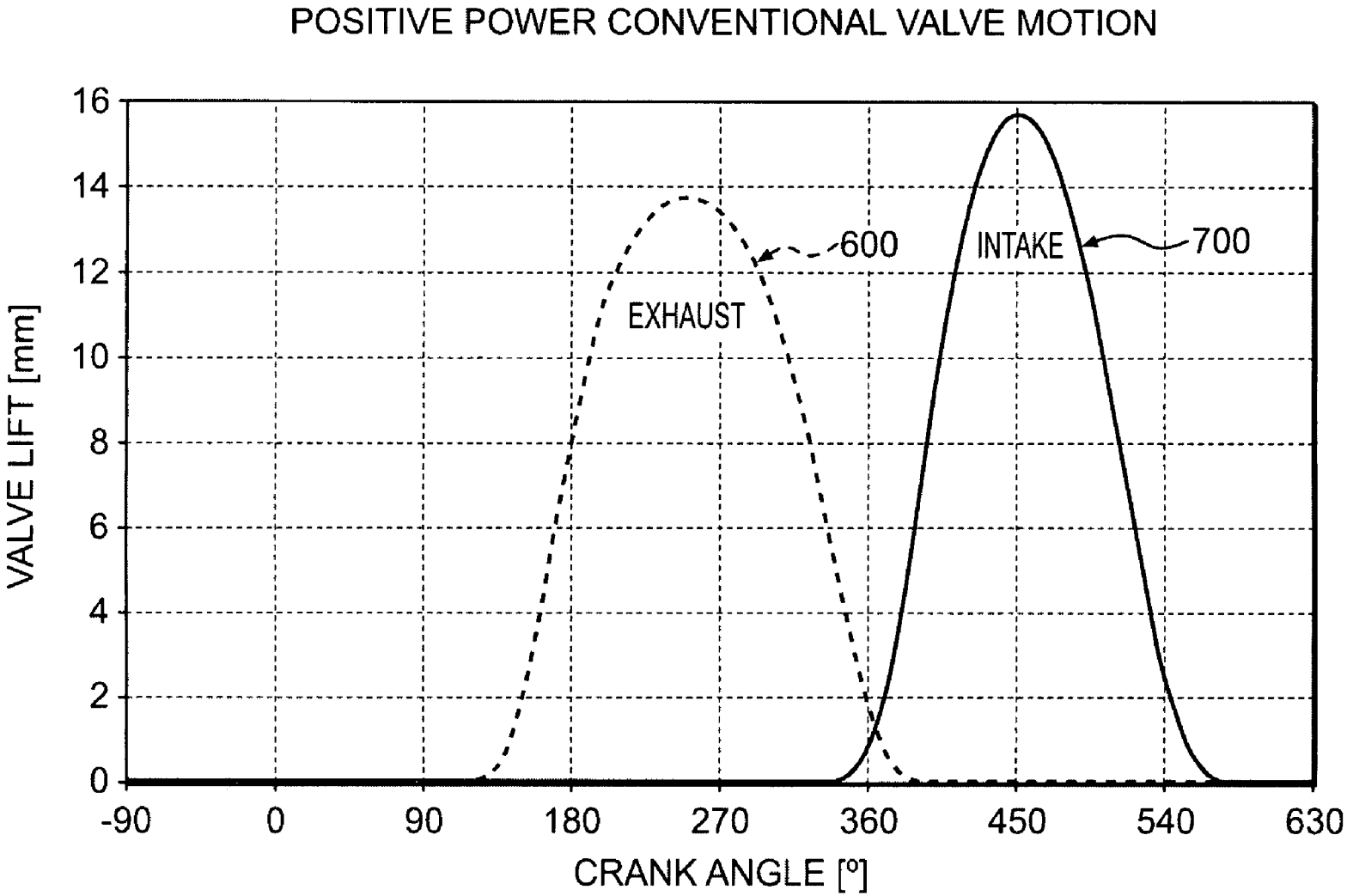
FIG. 10 is a graph of engine valve lift verses crank angle illustrating conventional positive power main intake and exhaust valve motions.
Figure 11:
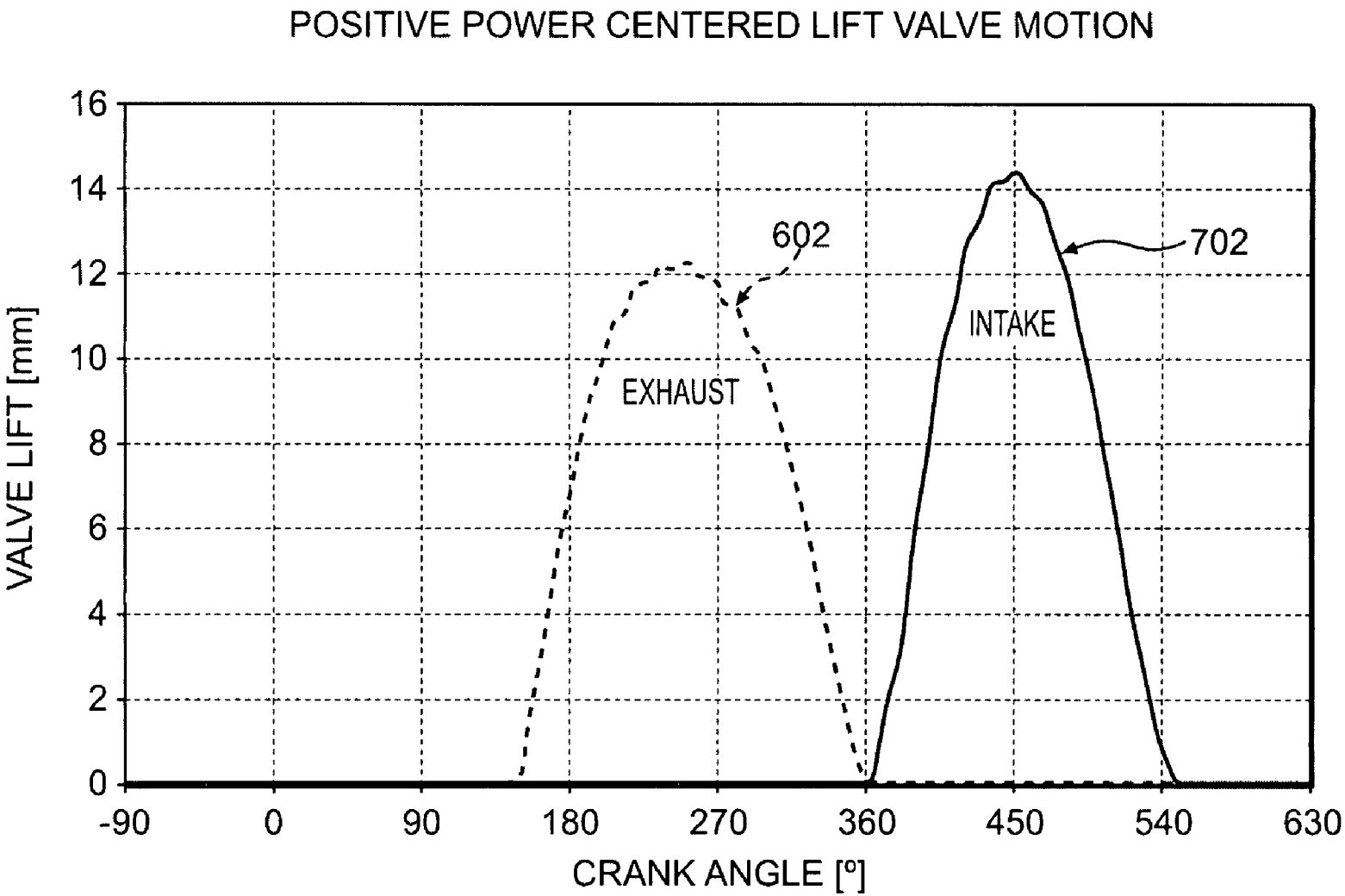
FIG. 11 is a graph of engine valve lift verses crank angle illustrating positive power centered lift main intake and exhaust valve motions.

When it is desired to have normal exhaust valve actuation, as opposed to early exhaust valve actuation, the lost motion system 200 may be operated to provide a centered lift motion, illustrated in FIG. 11. Centered lift of the exhaust and intake valves is illustrated by main exhaust event 602 and main intake event 702. As compared with a conventional exhaust event 600 and a conventional main intake event 700, shown in FIG. 10, the centered lift motions in FIG. 11 begin later, end sooner, and have a reduced lift. The centered lift motions may be achieved by maintaining the trigger valve for the lost motion system open as the master piston begins to move under the influence of the main event lobe on the cam. Maintaining the trigger valve open during part of the main event lobe allows some hydraulic fluid that would normally be used to displace the slave piston to flow to the accumulator instead. After the trigger valve is closed part way through the main event, the slave piston resumes following the motion prescribed by the main event lobe on the cam. The slave piston displacement, and thus the engine valve motion, is delayed and reduced in magnitude, however, because there is less hydraulic fluid in the master-slave circuit.

Figure 12:
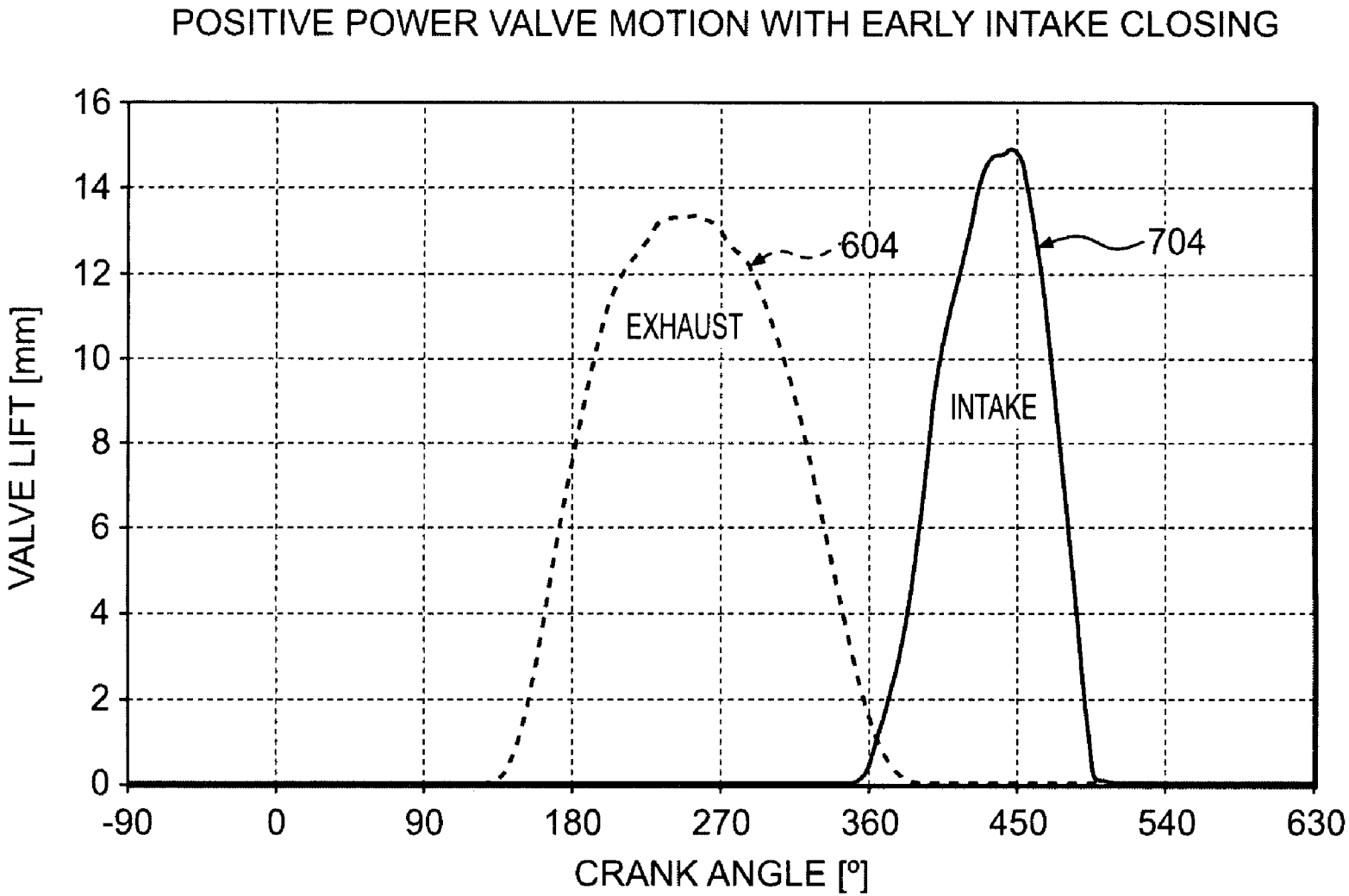
FIG. 12 is a graph of engine valve lift verses crank angle illustrating early intake valve closing during positive power operation.

Early intake valve closing and main exhaust actuation for positive power operation is illustrated in FIG. 12. The main intake event 704 ends sooner than the corresponding main intake event 700 shown in FIG. 10, and accordingly is referred to as early intake closing. The early intake valve closing may be accomplished by releasing high pressure hydraulic fluid from the master-slave circuit of a lost motion system before the master piston has completed the motion prescribed by the main intake lobe on the cam associated with the master piston. The release of this fluid may cause the slave piston and engine valves to collapse before the master piston returns them under the influence of the cam.

Figure 13:
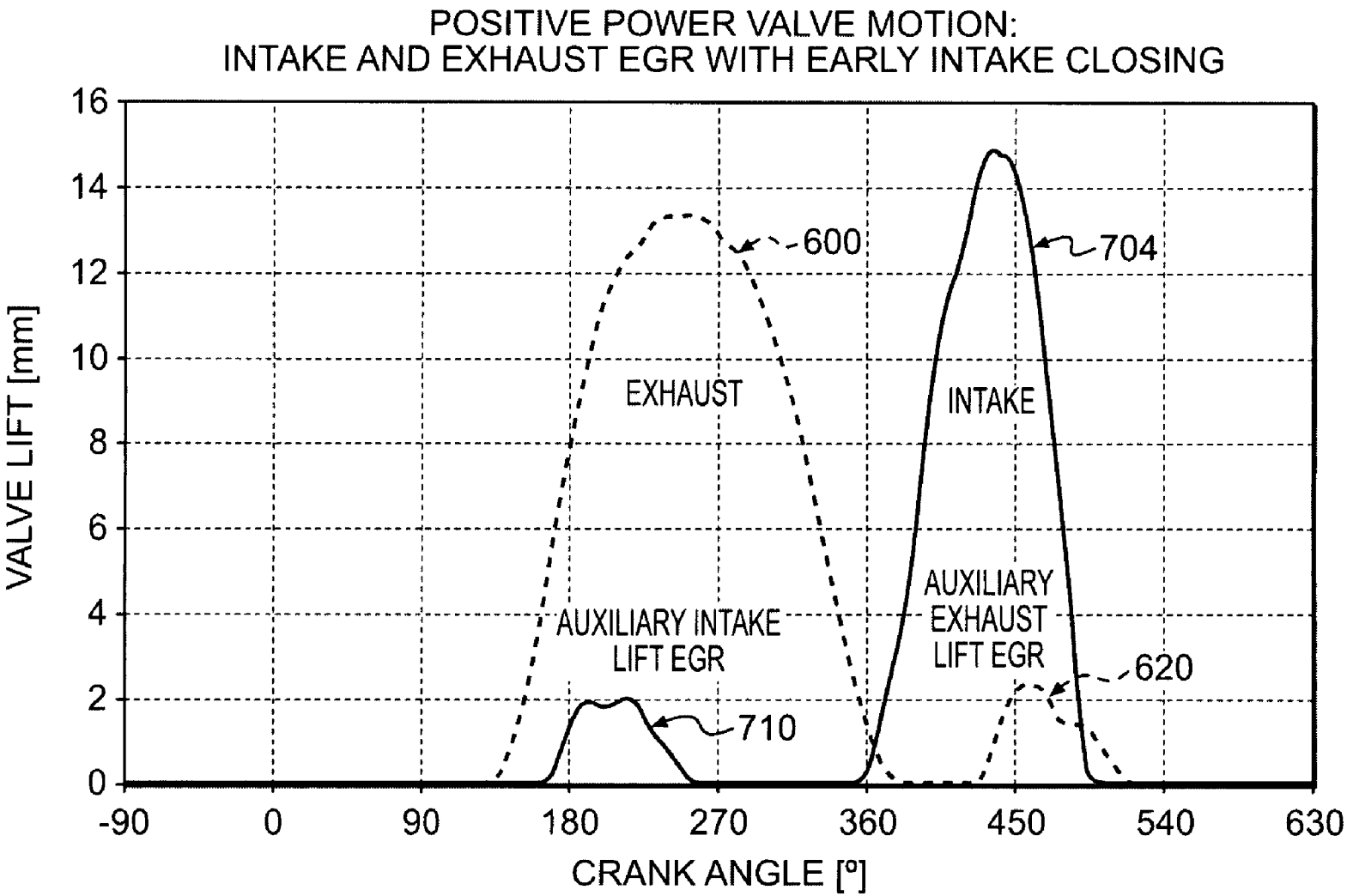
FIG. 13 is a graph of engine valve lift verses crank angle illustrating intake and exhaust valve EGR events carried out in conjunction with early intake valve closing during positive power operation.

With reference to FIG. 13, various engine valve actuations, and modifications thereof, that may be provided using the various system and method embodiments of the invention are shown. For example, an early intake closing event 704 is shown to be carried out with an optional intake valve EGR event 710 and an optional exhaust valve EGR event 620. The foregoing valve motions are intended to be exemplary. It is appreciated that the various system embodiments of the present invention may be used to carry out a wide variety of different valve events having variable timing and lift.

Figure 15:
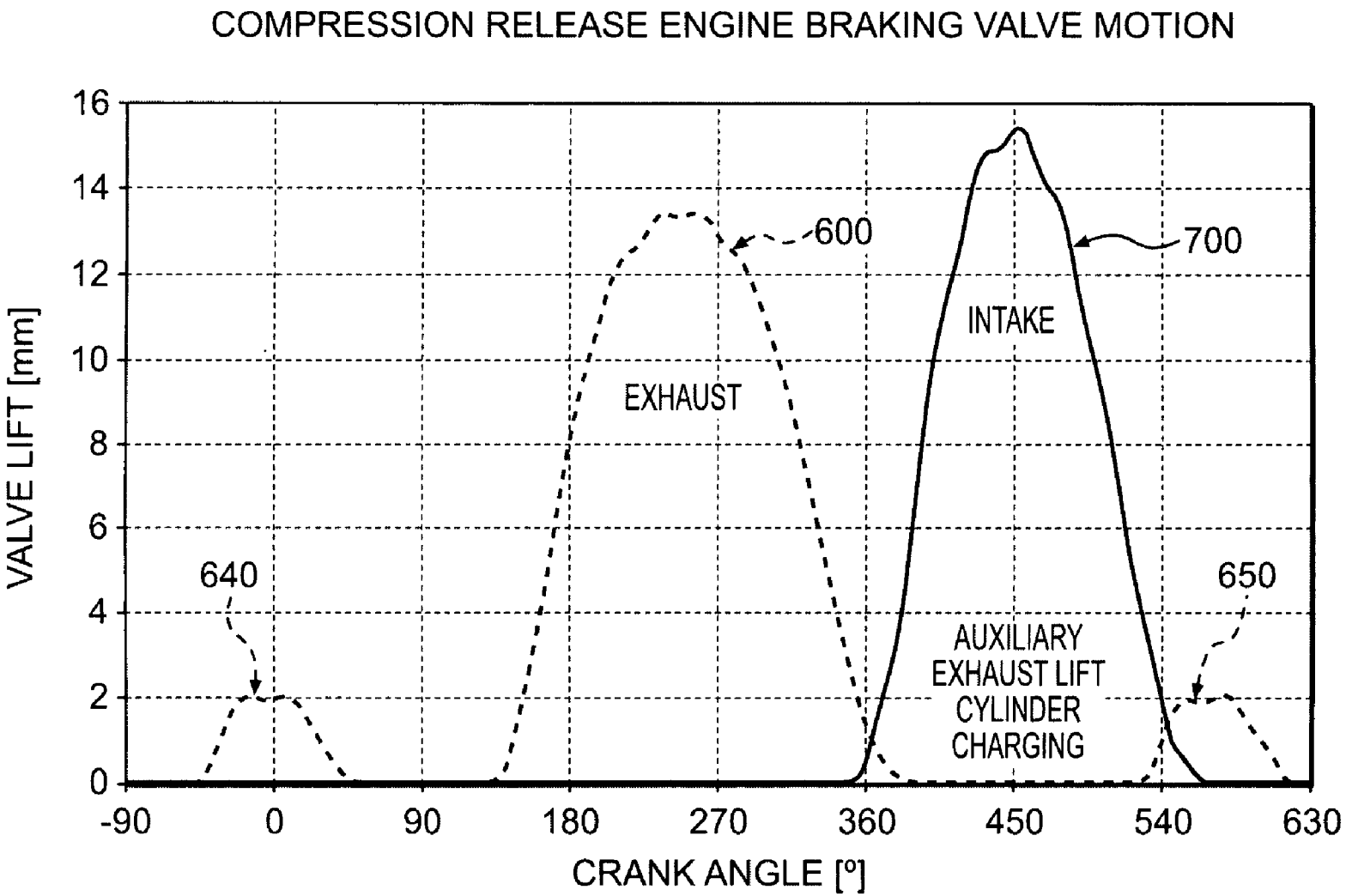
FIG. 15 is a graph of engine valve lift verses crank angle illustrating compression release engine braking valve motions.

With reference to FIG. 15, the various embodiments of the invention may be used to provide compression-release engine braking events 640 in combination with optional exhaust gas recirculation ("EGR") events 650. The main intake event 700 may provide auxiliary exhaust lift cylinder charging for engine braking.

For example, the foregoing embodiments of the invention may be used to reduce the "shake" commonly associated with diesel engines as they are shut down. The variable valve actuation system may be used to shut down the valve actuation in individual engine cylinders, one at a time, thereby reducing the shake that occurs when all cylinders are shut down simultaneously.

Figure 17:
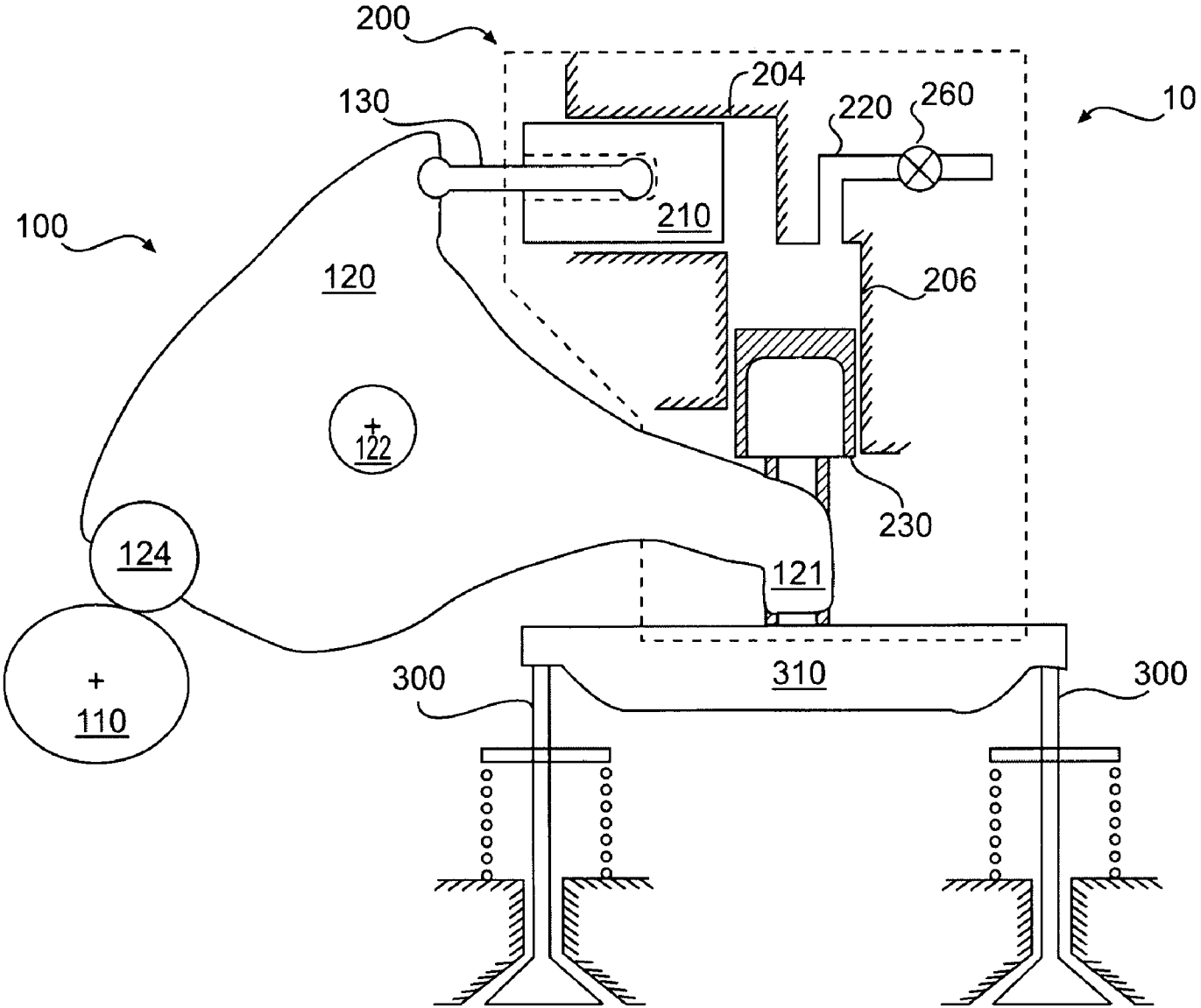
FIG. 17 is a schematic diagram of a valve actuation system in accordance with an embodiment of the present invention.

With reference to FIG. 17, in an alternative embodiment of the present invention, valve actuation may be provided primarily or secondarily through a lost motion system 200. A rocker arm 120 may receive motion from a motion imparting device, such as but not limited to a cam 110. As the rocker arm 120 encounters lobe(s) on the cam 110, it may pivot about the rocker shaft 122 and engage the lost motion system 200. The lost motion system 200 may generally be comprised of a master piston 210 and a slave piston 230. A means for imparting motion 100, such as the rocker arm 120, may contact and drive the master piston 210. This contact may be direct or it may be through an intermediate component, such as but not limited to, a push tube 130. The master piston 210 may be disposed in a bore 204 in a housing 202, such that the master piston 210 may slide within the bore 204 while maintaining an effective seal with the bore 204. The bore 204 in which the master piston 210 resides may be hydraulically connected to a second bore 206, in which the slave piston 230 may reside. The slave piston 230 may be disposed in the second bore 206 so that it may slide within the second bore 206 while maintaining an effective seal with the second bore 206.

The hydraulic circuit between the master piston 210 and the slave piston 230 (the master-slave circuit) may be selectively filled with hydraulic fluid under the control of valve 260 through conduit 220. Motion imparted to the master piston 210 by the rocker arm 120 may be transferred to the slave piston 230 and the engine valves 300 when the master-slave circuit is provided with sufficient fluid. Hydraulic fluid supply to and from the master-slave circuit may be provided at high speed when the valve 260 is a trigger valve. The use of a trigger valve to add and drain fluid from the master-slave circuit may permit high speed variable valve actuation.

In the embodiment shown in FIG. 17, the means for imparting motion 100 for the valve actuation system 10 may be equipped with an additional variable valve actuation feature. The additional VVA feature may be realized using a rocker arm 120 with an extension 121. The extension 121 may protrude from the rocker arm 120 and terminate in a head adjacent to the valve bridge 310, or an engine valve 300. A lash space may be provided between the extension arm 121 and the valve bridge 310. A slot may be provided in the slave piston 230 in order to receive the extension 121. The slot may be of sufficient size that the slave piston 230 and the extension 121 may move freely relative to one another without interference.

The additional VVA feature in the form of the extension 121 may be used to provide late valve opening and early valve closing when the extension 121 is used to actuate the engine valves 300 instead of the lost motion system 200. The designation of the extension 121 providing "late" valve opening and "early" valve closing is in comparison to the opening and closing times provided by the lost motion system 200 and is a function of there being a greater lash space between the extension 121 and the valve bride 310 then between the slave piston 230 and the valve bridge 310 as well as a function of the respective rocker ratio for the extension 121 and the effective rocker ratio for the slave piston 230.

The additional VVA provided by the extension 121 may be provided by either maintaining the valve 260 in an "open" position throughout the valve event or by selectively opening the valve 260 during the valve event. When the valve 260 is maintained open throughout the valve event, fluid is not trapped in the master-slave circuit, the motion of the master piston 210 is not transferred to the slave piston 230, and the valves 300 are actuated solely by the motion of the extension 121. When the valve 260 is selectively opened during the valve event only early valve closing is provided because normal valve opening is provided by the lost motion system 200 and early valve closing is provided by the extension 121.

The extension 121 may also provide a fail-safe mode of operation for the embodiment of the present invention shown in FIG. 17 in the event that the desired amount of hydraulic fluid needed for valve actuation using the lost motion system 200 is not maintained in the master-slave circuit. The lack of fluid in the master-slave circuit can be for any reason, such as a failure of the valve 260. In such an event, the motion imparted by the rocker arm 120 to the lost motion system 200 will not be effectively transferred to the engine valves 300. However, the motion of the rocker arm 120 about the rocker shaft 122 inherently causes the extension 121 to rotate about the rocker shaft as well. As a result, the motion of the extension 121 that exceeds the lash space between it and the valve bridge 310 may be transferred to the valve bridge 310 and valves 300, should the lost motion system 200 become inoperative. The hydraulic ratio of motion transferred from the master piston 210 to the slave piston 230 may be set such that the extension 121 does not "catch up" with the valve bridge 310 when it is actuated by the slave piston during non-failure mode. It may be only when the lost motion system 200 fails that the motion of the extension 121 is transferred to the valve bridge 310.

Figure 18:
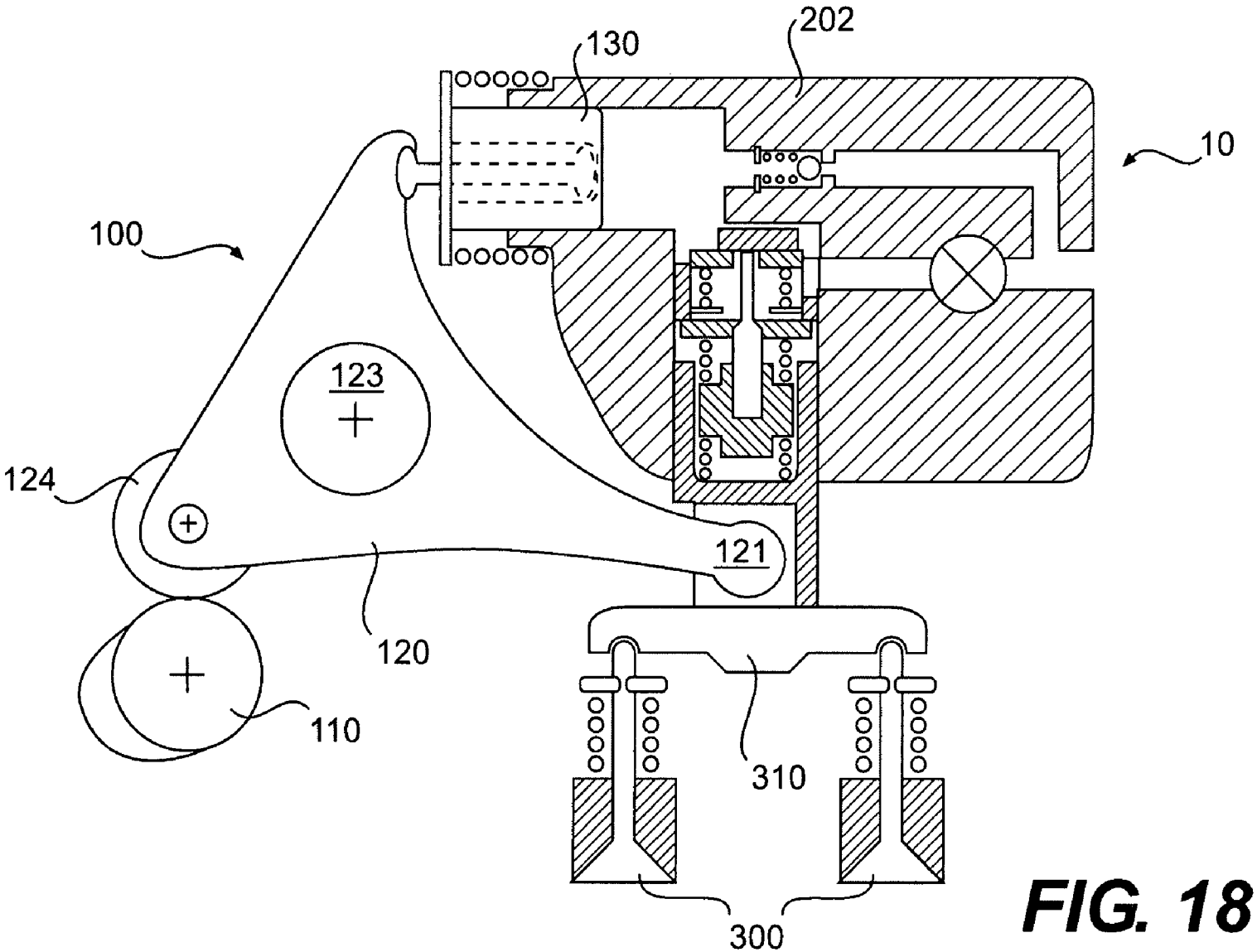
FIG. 18 is a schematic diagram of a valve actuation system in accordance with an embodiment of the present invention.

With reference to FIG. 18, in another embodiment of the valve actuation system 10, the lost motion system may also include a valve-catch subsystem to aid in slowly seating the one or more engine valves 300. The valve-catch subsystem shown in FIG. 18 is further illustrated in FIG. 20.

Figure 20:
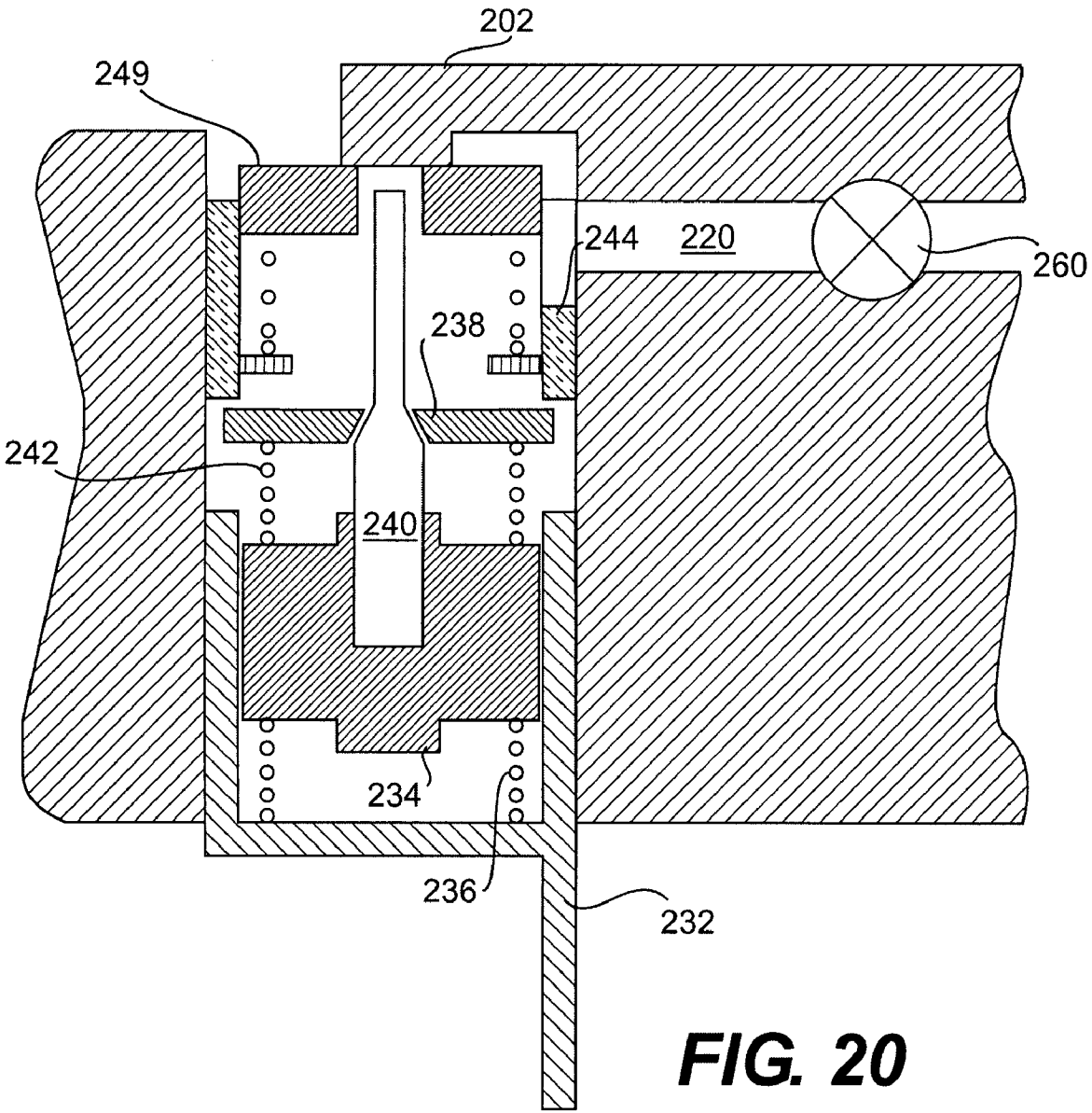
FIG. 20 is a cross section of a valve seating device in accordance with an embodiment of the present invention.

With reference to FIG. 20, the slave piston 230 may incorporate a valve seating assembly, also referred to as a valve catch. The valve seating assembly may include an outer piston 232, an inner piston 234, a lower spring 236 that biases the outer and inner pistons apart, a valve seating pin 240, a seating disk 238, an upper spring 242 that biases the inner piston and the seating disk 238 apart, and a valve closing disk 249 biased upward by a spring. The outer piston 232 may be adapted to slide relative to the bore within which it resides, while at the same time forming a seal with that bore. It is appreciated that some leakage past this seal may not affect the operation of the lost motion system 200. The inner piston 234 may be adapted to slide within the outer piston 232 to accommodate the formation of a small fluid chamber (where the lower spring 236 resides) between the two pistons. Slow leakage to and from this small fluid chamber may provide for automatic lash adjustment between the slave piston 230 and the valve bridge 310. Accordingly, it is preferable to provide enough leakage space between the inner piston 234 and the outer piston 232 to enable automatic lash take up.

The combination of the seating pin 240 and the seating disk 238 may be provided to decelerate the upward motion of the slave piston and progressively slow the engine valves 300 as they approach their respective seats (not shown). The seating pin 240 may extend into the inner piston 234 at a lower end, and up into the hydraulic circuit 220 at an upper end. The seating pin 240 may include one or more side extensions that check the position of the seating pin relative to the seating disk 238. In an alternative embodiment of the present invention (shown in FIGS. 7 and 8), the seating pin 240 may be fluted to progressively throttle fluid flow past the seating pin/seating disk interface to maintain a relatively constant seating force during the last 1–2 mm before final valve seating. Examples of fluted seating pins are disclosed in Vanderpoel et al., U.S. Pat. No. 6,474,277 (Nov. 5, 2002), which is assigned to the owner of the present application, and which is hereby incorporated by reference.

The seating disk 238 may be slidably disposed in the slave piston bore. A small gap may be provided between the seating disk 238 and the slave piston bore to allow some low level of hydraulic flow around the seating disk. The upward movement of the seating disk 238, and the flow around its outer edge, may be checked by a catch-cap 244 disposed at the juncture of the slave piston bore and the hydraulic circuit 220. A gap that permits some low level of hydraulic fluid flow may also be provided between the interior of the seating disk 238 and the seating pin 240. The upward translation of the seating pin 240 may be arrested as a result of contact between the upper end of the seating pin and the housing 202. Contact between the seating pin and the housing may automatically set the lash for the system and also provide a valve catch function.

Figure 21:
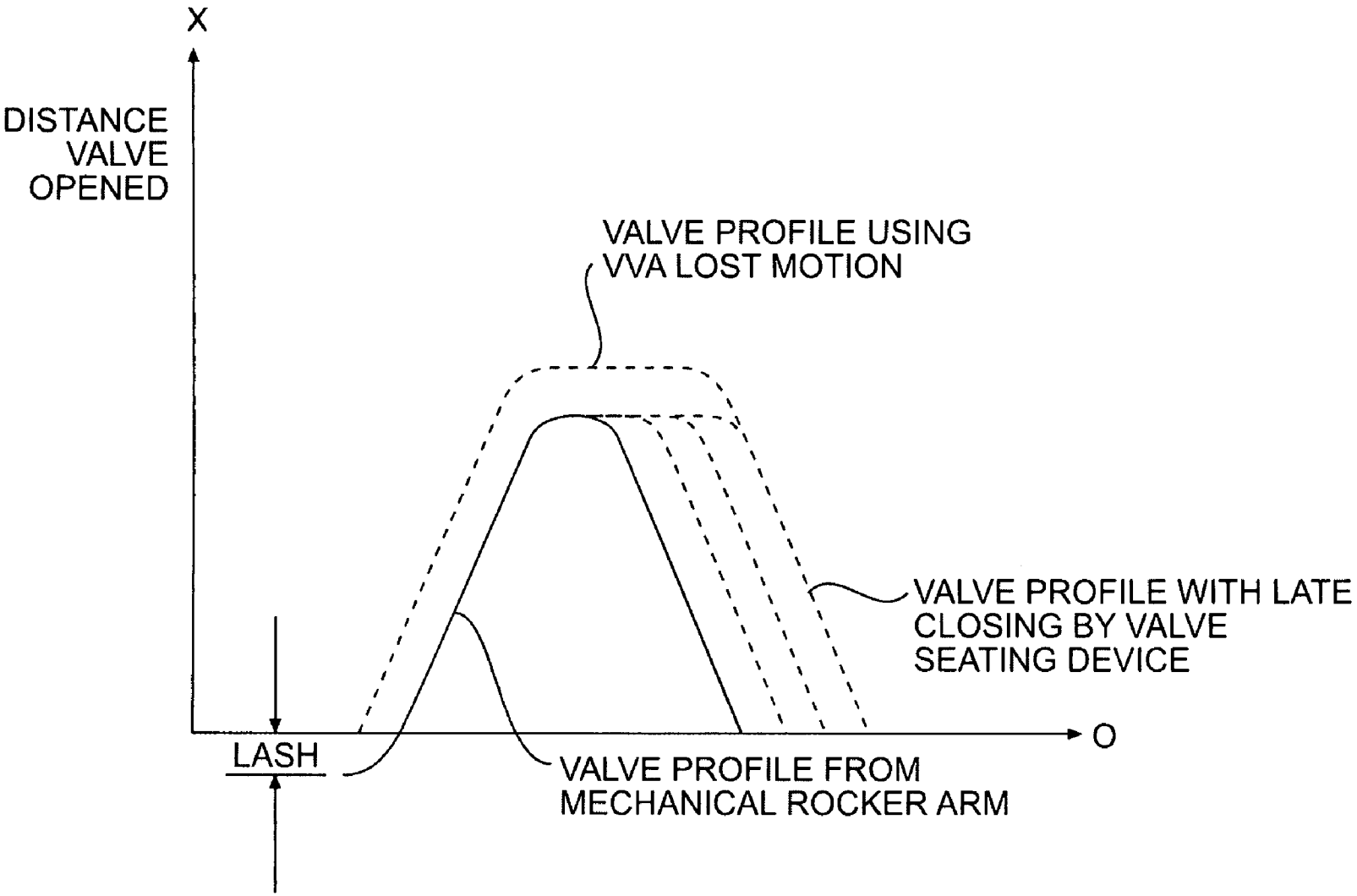
FIG. 21 is a graph depicting a valve profile, in accordance with an embodiment of the present invention.

When the trigger valve 260 is closed, hydraulic fluid may be contained between the seating disk 238 and the valve closing disk 249. As the engine valve begins to close, the slave piston 232 is pushed into the bore 206. This may cause the seating disk 238 and the valve closing disk 249 to be forced towards the master piston 210. As the valve closing disk 249 moves towards the master piston, it may contact the housing 202, which may terminate the upward translation of the valve closing disk 249. When the valve closing disk 249 contacts the housing 202, it effectively prevents hydraulic fluid from flowing back to the master piston. The hydraulic fluid may be trapped between the valve closing disk 249 and the slave piston 234, thereby preventing the valve from seating. In order to allow the valve to seat, the trigger valve 260 may be opened, allowing the hydraulic fluid to escape. In this manner, a late valve closing may be accomplished. If the trigger valve 260 is open, hydraulic fluid may not be contained between the seating disk 238 and the valve closing disk 249, and normal valve closing may occur. A graph illustrating a late closing valve profile may be seen at FIG. 21.

Figure 19:
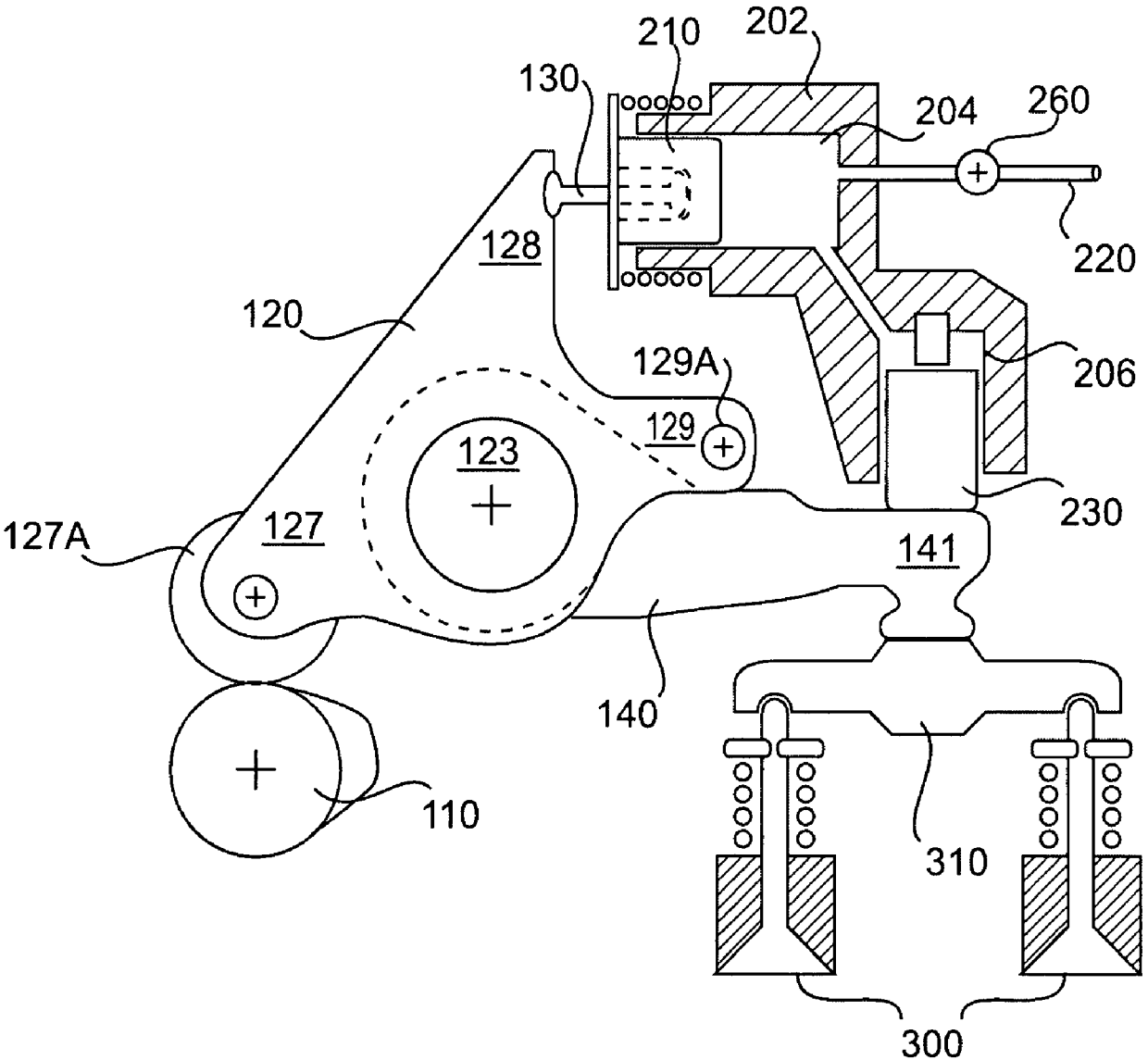
FIG. 19 is a schematic diagram of a valve actuation system in accordance with an embodiment of the present invention.

FIG. 19 shows an alternative embodiment of the valve actuation system 10. With continued reference to FIG. 19, the valve actuation system 10 is generally comprised of a first rocker arm 120, a second rocker arm 140, a lost motion system 200, and at least one engine valve 300.

A first portion of the first rocker arm 120 may contact a motion imparting device 110, such as but not limited to a cam, directly or through an intermediate device, such as but not limited to a roller or cam follower 127A. A second portion 128 of the rocker arm 120 may contact the lost motion system 200, either directly or through an intermediate device, such as but not limited to a pushtube 130. A third portion 129 of the rocker arm 120 may contact the second rocker arm 140 directly or through an intermediate device, such as but not limited to a pin or roller 129A.

The second rocker arm 140 may be mounted coaxially with the first rocker arm 120 on the rocker shaft 123. The second rocker arm 140 may have an actuation end 141 disposed between the lost motion system 200 and the one or more engine valves 300. The actuation end 141 may contact the one or more engine valves 300 directly or through an intermediate component, such as but not limited to a valve bridge 310. The actuation end 141 of the second rocker arm 140 may also be in contact with the third portion 129 of the first rocker arm 120. These components may be separated by a lash distance, between the third portion 129 of the first rocker arm 120 and the actuation end 141 of the second rocker arm 140. This lash may enable the first rocker arm 120 to rotate to a certain degree before contacting, and thus actuating, the second rocker arm 140. This delay in actuation may cause a delayed engine valve opening.

The lost motion system 200 may generally be comprised of a master piston 210 and a slave piston 230. The master piston 210 may be disposed in a bore 204 in a housing 202, such that the master piston 210 may slide within the bore 204 while maintaining an effective seal with the bore 204. The bore 204 of the master piston 210 may be hydraulically connected to a second bore 206, in which the slave piston 230 may reside. The slave piston 230 may be disposed in the second bore 206 so that it may slide within the second bore 206 while maintaining an effective seal with the second bore 206. The slave piston 230 may be disposed so that if the hydraulic circuit between the master piston 210 and the slave piston 230 is filled with hydraulic fluid, any motion of the master piston 210 into the bore 230, caused by the second portion 128 of the first rocker arm 120, may be transferred to the slave piston 230.

The slave piston 230 may act through the actuation end 141 to actuate the one or more engine valves 300 or intermediate device. Hydraulic fluid may be supplied to the hydraulic circuit between the master piston 210 and the slave piston 230 via a hydraulic conduit 220. Control of the hydraulic fluid supply from the hydraulic conduit 220 may be provided by a valve 260, which may be, but is not limited to, a trigger valve or solenoid valve.

Because of the lash between the third portion 129 of the first rocker arm 120 and the actuation end 141 of the second rocker arm 140, the motion transferred to the one or more engine valves 300 is provided only through the lost motion system 200. The rotation of the first rocker arm 120 does not cause actuation of the second rocker arm 140 because of the lash distance between each rocker arm. Instead, valve actuation motion is provided through the first portion 128 of the first rocker arm 120 to the lost motion system 200, which then actuates the one or more engine valves 300.

If the valve 260 fails in an open position, motion will not effectively be transferred from the master piston 210 to the slave piston 230. Without the necessary engine valve 300 actuation, engine failure may result. However, in the fail safe system 100 shown in FIG. 19, the engine valves 300 may still be actuated in the event of a hydraulic valve 260 failure by the second rocker arm 140. When the first rocker arm 120 receives motion from the motion imparting device 110, the first rocker arm 120 may rotate in a clockwise direction. As the first rocker arm 120 rotates, the third extrusion 129 may contact the second rocker arm 140. The second rocker arm 140 may thus be forced to also rotate in a clockwise direction. As the second rocker arm 140 rotates, the arm 141 may contact the one or more engine valves 300 or intermediate component, thereby actuating the one or more engine valves 300.

It is also possible for the VVA valve 260 to fail in a closed position, thereby maintaining fluid in the hydraulic circuit. This may cause the engine valves 300 to be held in an open position. If the engine valves 300 are held in an open position, there is a risk of valve or engine damage due to contact between the valves and the piston. Such contact would occur at approximately a top dead center (TDC) position. Another embodiment of the fail-safe system 100, depicted in FIG. 19 may prevent this possible valve and/or engine damage.

It will be apparent to those skilled in the art that variations and modifications of the present invention can be made without departing from the scope or spirit of the invention. For example, the components and arrangement of the lost motion system 200, as shown in FIGS. 2, 3, 5, 7, 9, 16, 17 and 18 are for exemplary purposes only. It is contemplated that other components necessary for a properly operating lost motion system may be provided and that the arrangement of the master piston, the slave piston, the trigger valve, and the accumulator, may vary depending on a variety of factors, such as, for example, the specification of the engine. Thus, it is intended that the present invention cover all such modifications and variations of the invention, provided they come within the scope of the appended claims and their equivalents.

What is claimed is:

1. A valve actuation system comprising:

a lost motion system having a master piston bore and a slave piston bore, wherein the master piston bore and the slave piston bore intersect, a master piston slidably disposed in the master piston bore, wherein the master piston is adapted to receive an input motion, and a slave piston slidably disposed in the slave piston bore, wherein the slave piston is adapted to actuate one or more engine valves; and a rocker arm having a first contact portion adapted to provide input motion to the master piston and a second contact portion adapted to provide selective actuation for the one or more engine valves.

2. The system of claim 1 further comprising an engine valve bridge disposed between the one or more engine valves and the second contact portion.

3. The system of claim 1 wherein a lash space is selectively provided between the second contact portion and the one or more engine valves.

4. The system of claim 1 wherein the lost motion system further comprises:

a hydraulic supply passage communicating with the slave piston bore; and a trigger valve operatively connected to the hydraulic supply passage.

5. The system of claim 1 wherein the slave piston further comprises means for seating the one or more engine valves.

6. The system of claim 5 wherein the means for seating further comprises means for selectively preventing the one or more engine valves from seating.

7. The system of claim 1 wherein the slave piston further comprises a valve seating assembly.

8. The system of claim 7 further comprising:

a trigger valve; and a hydraulic passage extending between the trigger valve and the valve seating assembly.

9. The system of claim 8 further comprising:

a hydraulic fluid supply passage communicating with the master piston bore; and a check valve disposed in the hydraulic fluid supply passage.

10. The system of claim 4 wherein the trigger valve is adapted to provide high speed actuation.

11. The system of claim 4 further comprising a fluid accumulator in hydraulic communication with the trigger valve.

12. The system of claim 1 wherein the master piston bore and the slave piston bore extend in directions substantially perpendicular to each other.

13. The system of claim 6 wherein the means for selectively preventing the one or more engine valves from seating further comprises means for providing bleeder braking.

14. The system of claim 1 further comprising:

a second rocker arm disposed adjacent to the rocker arm, said second rocker arm having a rocker shaft receiving end, an actuation end, and an intermediate portion between the rocker shaft receiving end and the actuation end, wherein the rocker arm second contact portion selectively contacts the second rocker arm intermediate portion, and the second rocker arm actuation end is disposed between the slave piston and the one or more engine valves.

15. The system of claim 1 further comprising:

a second rocker arm disposed adjacent to the rocker arm, said second rocker arm having a rocker shaft receiving end, an actuation end, and an intermediate portion between the rocker shaft receiving end and the actuation end, wherein the rocker arm second contact portion selectively contacts the second rocker arm intermediate portion, and the second rocker arm actuation end is disposed between the slave piston and a valve bridge associated with the one or more engine valves.

16. A valve actuation system comprising:

a lost motion system having a master piston bore and a slave piston bore, wherein the master piston bore and the slave piston bore extend axially in directions substantially perpendicular to each other, a master piston slidably disposed in the master piston bore, wherein the master piston is adapted to receive an input motion, and a slave piston slidably disposed in the slave piston bore, wherein the slave piston is adapted to actuate one or more engine valves; and a rocker arm having a first contact portion adapted to provide input motion to the master piston and a second contact portion adapted to selectively actuate the one or more engine valves.

17. The system of claim 16 further comprising an engine valve bridge disposed between the one or more engine valves and the second contact portion.

18. The system of claim 16 wherein a lash space is selectively provided between the second contact portion and the one or more engine valves.

19. The system of claim 16 wherein the lost motion system further comprises:

a hydraulic supply passage communicating with the slave piston bore; and a trigger valve operatively connected to the hydraulic supply passage.

20. The system of claim 16 wherein the slave piston further comprises means for seating the one or more engine valves.

21. The system of claim 20 wherein the means for seating further comprises means for selectively preventing the one or more engine valves from seating.

22. A method of providing variable valve actuation for an internal combustion engine valve comprising the steps of:

actuating the engine valve for a valve event during at least a positive power mode of engine operation using a lost motion system;

discontinuing actuating the engine valve for the valve event during at least a positive power mode of engine operation using the lost motion system; and actuating the engine valve for the valve event during at least a positive power mode of engine operation using a rocker arm.

23. The method of claim 22 wherein the step of discontinuing actuating the engine valve is responsive to a failure in the lost motion system.

24. The method of claim 22 wherein the step of discontinuing actuating the engine valve is responsive to selective deactivation of the lost motion system.

25. The method of claim 22 further comprising the step of providing a lower amount of lift for the valve event using the rocker arm as compared to the amount of lift provided for the valve event using the lost motion system.

26. The method of claim 22 further comprising the step of providing different valve event timing using the rocker arm as compared to the valve event timing provided using the lost motion system.

* * * * *